US010064787B2

(12) United States Patent
Deutschle et al.

(10) Patent No.: US 10,064,787 B2
(45) Date of Patent: Sep. 4, 2018

(54) SUPPORTING STRUCTURE FOR SUPPORTING CONTAINERS FOR SUBSTANCES FOR MEDICAL, PHARMACEUTICAL OR COSMETIC APPLICATIONS AS WELL AS TRANSPORT AND PACKAGING CONTAINER COMPRISING THE SAME

(71) Applicant: SCHOTT AG, Mainz (DE)

(72) Inventors: Gregor Fritz Deutschle, Wiesbaden (DE); Edgar Pawlowski, Stadecken-Elsheim (DE)

(73) Assignee: SCHOTT AG, Mainz (DE)

( * ) Notice: Subject to any disclaimer, the term of this patent is extended or adjusted under 35 U.S.C. 154(b) by 810 days.

(21) Appl. No.: 14/519,725

(22) Filed: Oct. 21, 2014

(65) Prior Publication Data

US 2015/0108034 A1 Apr. 23, 2015

(30) Foreign Application Priority Data

Oct. 21, 2013 (DE) ..... 10 2013 111 600

(51) Int. Cl.
*A61J 1/16* (2006.01)
*B65D 25/10* (2006.01)
(Continued)

(52) U.S. Cl.
CPC . *A61J 1/16* (2013.01); *B01L 9/06* (2013.01); *B65D 25/108* (2013.01);
(Continued)

(58) Field of Classification Search
CPC . B65D 25/108; B01L 9/06; A61J 1/16; A61M 5/002
(Continued)

(56) References Cited

U.S. PATENT DOCUMENTS 3,643,812 A 2/1972 Mander
4,278,176 A * 7/1981 Adams ..... B01L 9/06 206/443
(Continued)

FOREIGN PATENT DOCUMENTS

CN 102470207 5/2012
CN 102905989 1/2013
(Continued)

OTHER PUBLICATIONS

English translation of Extended European Search Report in EP 2014 189 210.9, dated Nov. 19, 2015.

*Primary Examiner* — Anthony Stashick
*Assistant Examiner* — Raven Collins
(74) *Attorney, Agent, or Firm* — Ohlandt, Greeley, Ruggiero & Perle, L.L.P.

(57) ABSTRACT

Disclosed is a supporting structure for concurrently supporting a plurality of containers for substances for medical, pharmaceutical or cosmetic applications, comprising a flat, rectangular-shaped carrier having a plurality of apertures or receptacles and at least one supporting member, which is releasably coupled to the carrier, wherein the respective supporting member is configured to support a plurality of containers to said carrier by a positive-fit.

Figure 1:
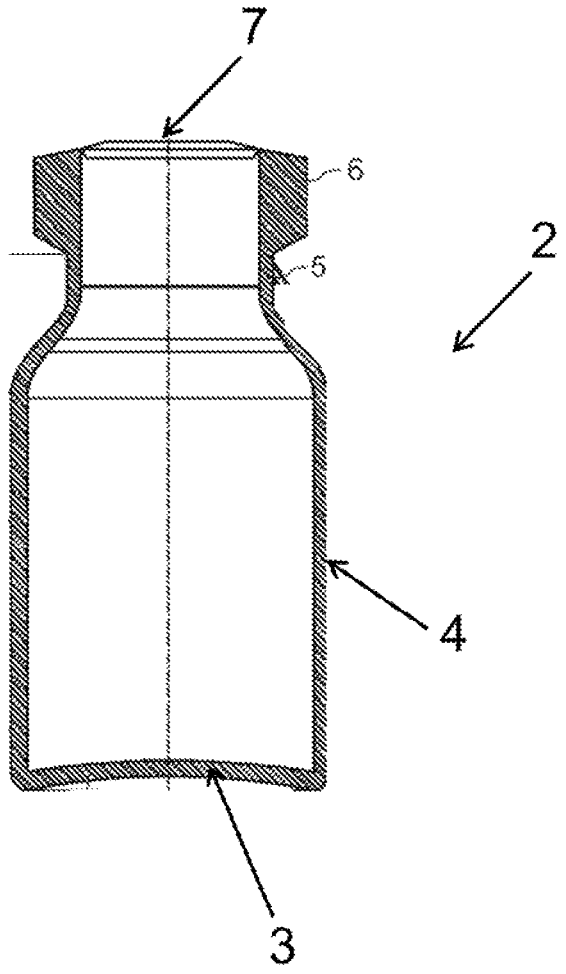

According to the invention the positive-fit is formed by coupling the respective supporting member with the carrier such that the containers supported on the container extend into the apertures or receptacles of the carrier.

By means of the supporting members tolerances, in particular with respect to the outer radius or the outer contour of the containers and to their length, can be compensated for in a simple manner. Because the containers extend through the apertures of the carrier, the bottoms of the containers are freely accessible from the underside of the carrier even if these are supported on the carrier. This offers significant
(Continued)

advantages when processing or further processing the containers. Since the supporting means are clipped into the carrier, these are retained to the carrier in axial direction and thus are supported very reliably on the carrier.

12 Claims, 37 Drawing Sheets

(51) Int. Cl.
*B01L 9/06* (2006.01)
*B01L 3/00* (2006.01)

(52) U.S. Cl.
CPC ..... *B01L 3/50855* (2013.01); *B01L 2200/18* (2013.01); *B01L 2300/022* (2013.01); *B01L 2300/123* (2013.01)

(58) Field of Classification Search
USPC ..... 206/562, 364, 557; 422/102, 130
See application file for complete search history.

(56) References Cited

U.S. PATENT DOCUMENTS 5,128,105 A * 7/1992 Berthold ..... B01L 9/06 422/561
5,700,429 A * 12/1997 Buhler ..... B01L 9/06 206/443
7,428,807 B2 9/2008 Bush
8,100,263 B2 1/2012 Vanderbush
8,118,167 B2 2/2012 Togashi
2001/0002984 A1 6/2001 Vetter
2012/0114457 A1 5/2012 Nicoletti
2012/0181285 A1 7/2012 Krauss
2013/0048531 A1 2/2013 Nicoletti
2013/0105503 A1 5/2013 Cognard
2013/0161225 A1 6/2013 Lepot
2013/0186793 A1 7/2013 Gagnieux

FOREIGN PATENT DOCUMENTS

DE 102009027454 A1 1/2011
DE 102012103899 A1 11/2013
DE 102012110973 A1 6/2014
EP 1449551 A1 8/2004
EP 1797761 B1 6/2007
EP 2119463 A1 11/2009
WO 2009015862 A1 2/2009
WO 2010086128 A1 8/2010
WO 2011135085 A1 11/2011
WO 2013063015 A1 5/2013
WO 2014033766 A1 3/2014

* cited by examiner

SUPPORTING STRUCTURE FOR SUPPORTING CONTAINERS FOR SUBSTANCES FOR MEDICAL, PHARMACEUTICAL OR COSMETIC APPLICATIONS AS WELL AS TRANSPORT AND PACKAGING CONTAINER COMPRISING THE SAME

The present application claims the priority of German patent application no. 10 2013 111 600, "Supporting structure for supporting containers for substances for medical, pharmaceutical or cosmetic applications, as well as transport and packaging container comprising the same", filed on Oct. 21, 2013, the entire content of which is hereby incorporated by way of reference for purposes of disclosure.

FIELD OF THE INVENTION

The present invention generally relates to the simultaneous supporting (holding) of a plurality of containers for the storage of substances for medical, pharmaceutical or cosmetic applications, in particular of vials, ampoules, cartridges, dual-chamber cartridges, syringes or dual-chamber syringes, and relates in particular to the simultaneous supporting of a plurality of such containers in a supporting structure in a simple and reliable manner and in such a manner that these, while supported by the supporting structure, can be processed in filling apparatus or processing plants or can be processed further, particularly in a sterile tunnel, in a filling apparatus for liquid medical or pharmaceutical agents or in a freeze-dryer for this purpose. The present invention further relates to a transport and/or packaging container comprising at least one such supporting structure and optionally an integrated sensor and/or an anti-counterfeiting protection.

BACKGROUND OF THE INVENTION

Medication containers, for example vials, ampoules or carpoules, are widely used as containers for preservation and storage of medical, pharmaceutical or cosmetic preparations to be administered in a liquid form, in particular in pre-dosed amounts. These generally have a cylindrical shape, can be made of plastic or glass and are available in large quantities at low costs. In order to fill the containers under sterile conditions as efficiently as possible concepts are increasingly used according to which the containers are already packaged in a transport or packaging container at the manufacturer of the containers under sterile conditions, which are then unpacked and further processed at a pharmaceutical company under sterile conditions, in particular in a so-called sterile tunnel.

For this purpose, various transport and packaging containers are known from the prior art, in which a plurality of medication containers are concurrently arranged in a regular arrangement, for example in a matrix configuration along rows and columns extending perpendicular thereto. This has advantages in the automated further processing of the containers because the containers can be passed to processing stations, for example to processing machines, robots or the like, at controlled positions and in a predetermined arrangement. For the transfer to a processing station it is just required to properly position and open the transport and packaging container. The downstream processing station will then know at what position and in what arrangement the containers to be processed further are arranged.

Such a transport and packaging container and a corresponding packaging concept is disclosed for example in U.S. Pat. No. 8,118,167 B2. The further processing of the containers is, however, always performed such that the supporting structure will be removed from the transport and packaging container, that the containers will be removed from the supporting structure and isolated and then individually placed on a conveyor, in particular a conveyor belt, and passed to the processing stations individually for the further processing. This limits the speed of processing that can be achieved. Particularly in the isolation of the containers by means of cell wheels or the like, it always occurs that individual containers abut uncontrolled, which results in an undesired abrasion and subsequently in a contamination of the interior volume of the containers or of the processing station and in an impairment of the outer appearance of the containers which is undesirable.

U.S. Pat. No. 8,100,263 B2 discloses a portable transport and packaging container that can be packed in a sterile manner, in which a plate-shaped supporting structure can be inserted which supports a plurality of medication containers in a regular arrangement. However, the medication containers cannot be processed further while they are accommodated in the transport or packaging container or supported in the supporting structure, but must be isolated first in the conventional manner and handed over to downstream processing stations.

There exist no packaging solutions for vials, that can be freeze-dried (lyophilized) and sealed in the supporting structure (in the so-called nest) and/or within the packaging without significant influence on this process. The supporting variants disclosed by WO 2010/086128 A1 support the vials in the nest on the bottom. Since the nest that serves as a supporting structure acts to isolate between the base plate of the freeze-dryer and the vials, the heat transfer is impaired and hardly economical.

WO 2009/015862 A1 discloses an approach using a nest serving as a supporting structure, which approach is based on a fixed coupling with the vials by means of a friction fit. Due to the fact that plastic nests can never be made without tension and that the vials usually have different lengths, it follows that individual vials get out of contact with the bottom in a freeze-dryer during the process. The freeze-drying process can therefore be unstable and difficult to control.

Furthermore, in this approach, the vials cannot be re-introduced from above into the nest e.g. after performing an inspection or an "in-process-control". However, many pharmaceutical manufacturers request a strict avoidance of any intrusion of particles from above into the filling apertures of the vials. Thus, inserting the measured or tested vials from above into the nest during the processing is desired.

The freeze-drying process is one of the most expensive processes for the production of pharmaceuticals. As the costs essentially depend on the packing density that can be achieved during processing and freeze-drying, this has to be optimized.

Furthermore, the existing packaging solutions are not flexible enough to transport vials of different sizes. Most solutions using a nest make use of the outer diameter of the vials as an auxiliary contour for fixing. This, however, is usually not standardized and is subject to otherwise often relatively high tolerances.

In the supporting structures according to WO 2011/135085 A1 and WO 2009/015862 A1 the vials cannot be kept free of stress in the supporting structure, which would otherwise result in an undesirable bulging of the supporting structure, in particular during the processing, for example in a freeze-dryer.

In any case a direct contact with the bottoms of the medication containers, in particular with the bottoms of vials, is not possible for the conventional supporting structures. However, this complicates the further-processing of the medication containers, in particular if their content is to be subjected to a freeze-drying process (also known as lyophilization or sublimation drying). In addition, a further processing of the medication containers directly in the supporting structures is not possible, because they are supported there either in a rigid manner or they are not accessible for further processing to a sufficient extent, so that conventionally the medication containers must be removed from the supporting structures for a further processing, which is time-consuming and expensive.

SUMMARY OF THE INVENTION

The object of the present invention is to further enhance the supporting of containers used for storage of substances for medical, pharmaceutical or cosmetic applications, particularly so that these containers can be handled, transported and processed more quickly and economically and such that these processes can be automated better and in a more reliable manner.

According to the present invention there is provided a supporting structure supporting structure for concurrently supporting a plurality of containers for substances for medical, pharmaceutical or cosmetic applications, comprising a flat, rectangular-shaped carrier having a plurality of apertures or receptacles and at least one supporting member, which is releasably coupled to the carrier, wherein the respective supporting member is configured to support a plurality of containers to said carrier by a positive-fit. According to the present invention the positive-fit is formed by coupling the respective supporting member with the carrier is configured such that the containers supported on the container extend into the apertures or receptacles of the carrier Because the containers extend into the apertures in the carrier or extend in particular through these apertures, the bottoms of the containers are freely accessible from the underside of the supporting structure even if these are supported on the carrier. This offers significant advantages when processing or further processing the containers, because it is not necessary to remove them out of the supporting structure or to separate (isolate) them, but instead they may be handled or processes while they are supported on the supporting structure. For example, the containers can be placed on an external supporting surface or placed in a full-scale and direct contact with a cooling surface, e.g. with a cooling finger of a freeze-dryer.

Preferably, the respective supporting member is configured such that tolerances of the containers, in particular with respect to the outer radius or the outer contours of the containers as well as their length, can be compensated for in a simple manner. Thus, tolerances with respect to the outer radius or the outer contours of the containers may be compensated, for example, simply by means of a certain radial clearance, with which the containers are supported by the supporting member, or by means of a certain resiliency or deformability of the supporting receptacles of the supporting member. Tolerances or length differences between individual containers in the axial direction can be compensated easily because the respective supporting member retains the containers with a clearance in axial direction by means of a positive-fit in only one direction.

According to a further embodiment the positive-fit coupling is formed such that the containers are retained at the at least one supporting member in axial direction in the region of a constricted neck portion and below an expanded upper rim following the constricted neck portion. In this way a form-locking only in one direction can be implemented in a simple manner.

According to a further embodiment, the positive-fit coupling is formed such that the respective containers rest loosely with the underside of the expanded upper rim edge on a respective supporting member or on supporting means, which are formed on the respective supporting member. In this way the above-mentioned supporting of the containers can be implemented easily also with a radial clearance.

According to a further embodiment, the supporting structure comprises a plurality of supporting members that are each strip-shaped and extend along a longitudinal side of the carrier. The containers can be supported in a positive-fit manner along the longitudinal sides of the supporting member, wherein the regular geometric arrangement of the containers can be set in a simple manner. Preferably, the containers are in particular hinged in the supporting members.

According to a further embodiment annular supporting pieces are formed on the supporting members, which are configured for embracing the outer periphery of the container in a positive-fit manner. Here, the annular supporting pieces are arranged preferably at uniform distances from one another and along the respective supporting member and the aperture width of the annular receptacles is respectively larger than the outer diameter of a constricted neck portion of the container but smaller than the outer diameter of an upper rim of the container, which follows the constricted neck portion. In this way the containers can rest loosely with the underside of the upper rims of the containers on the upper sides of the annular receptacles and are thus supported on the supporting pieces both with radial play and with axial play.

According to a further embodiment the plurality of containers are supported on the carrier by respective pairs of adjacent supporting members in rows and columns. The supporting members can be strip-shaped, having straight longitudinal sides, on which the containers rest with the undersides of the expanded upper rims. Alternatively, a plurality of semi-circular recesses can be respectively formed along at least one longitudinal side of the supporting members, which form a plurality of annular receptacles in cooperation with the semi-circular recesses of a directly adjacent strip-shaped supporting member, in which the containers are supported as outlined above. Here, the semi-circular recesses can be arranged in particular along opposite longitudinal sides of the supporting members respectively displaced to each other, which may enable an even higher packing density. Thus, a row-wise processing of containers is considerably facilitated, in which a series of containers are inserted into the recesses of a strip by means of a row of grippers or the like, then an additional strip is inserted such that its recesses also embrace the containers, and then the two strips are brought together close enough so that a row of containers is held reliably by the two strips and, finally, the two strips are clipped together in the carrier. The recesses may also have the shape of a half-ellipse so that containers having different outer dimensions can be processed by means of one and the same supporting structure.

According to a further embodiment, the supporting members are strip-shaped and respective pairs of adjacent supporting members support the plurality of containers on the carrier in rows or columns. Here, the supporting members each have two wings which are elastically tensioned against one another such that, in a first position of the supporting members in which the wings are displaced toward each other, the supporting members can be inserted into the interspaces between the upper ends of rows or columns of containers, and that, in a second position of the supporting members in which the wings are folded apart caused by the resilient tensioning, the upper ends of the supporting members support the containers on the carrier in rows or columns.

According to a further embodiment, the respective supporting member is held on the carrier by clamping. Thus, the supporting members can be removed easily from the supporting structure and then re-attached reliably at predetermined positions.

According to a further embodiment, each supporting member is coupled with the carrier by means of a clip-coupling. Thus, the supporting members can be removed easily from the supporting structure and then re-attached reliably at predetermined positions, wherein these positions can be set precisely by means of the structures used for the clip-coupling. For this purpose at least one first latching element may be disposed on the carrier or the respective supporting member, and at least one second latching element may be disposed on the respective supporting member or on the carrier, wherein the first and the second locking element can be latched for coupling the carrier with the respective supporting member.

According to a further embodiment, a plurality of apertures is formed in the at least one supporting member and the respective supporting member is supported on the carrier such that it can be moved in parallel relative to the carrier, wherein, in a first position of the supporting member relative to the carrier, the apertures of the supporting member are aligned with the apertures or receptacles of the carrier such that the upper ends of the containers respectively can be inserted into the apertures of the supporting member, and wherein said supporting member can be displaced by a parallel displacement relative to the carrier to a second position, in which the positive-fit is accomplished by the cooperation of the apertures in the supporting member with the apertures or receptacles in the carrier for supporting the containers on the carrier.

According to a further embodiment, a plurality of apertures are formed in the at least one supporting member to which a respective plurality of supporting means is associated for supporting the container, wherein the respective supporting member can be displaced perpendicularly to the upper side of the carrier. Here, the apertures of the supporting member can be aligned with apertures or receptacle of the carrier, and, in a first position, in which the distance between the at least one supporting member and the carrier is greater than a predetermined minimum distance, the supporting means associated to a respective aperture of the supporting member can be arranged spaced apart from each other such that the upper ends of the containers each can be inserted into the respective apertures of the supporting member. Furthermore, the supporting means associated to the apertures of the supporting members can be adjusted by decreasing the distance between the at least one supporting member and the carrier in a coordinated manner to a second position, in which the upper ends of the containers are each supported by the supporting means.

According to a further embodiment the supporting member and the carrier are arranged one above the other, wherein the supporting means are formed as resilient supporting arms and are disposed on the supporting member and wherein the resilient supporting arms cooperate with the carrier such that these can be adjusted in a coordinated manner between the first position and the second position upon changing the distance between the supporting member and the carrier.

According to a further embodiment, for the coordinated adjustment, the resilient supporting arms are guided in the apertures or in slots formed in the carrier and the resilient supporting arms get in contact with guide members or edges of the apertures of the carrier if the distance between the supporting member and the carrier falls below said predetermined minimum distance to be adjusted to said second position in a coordinated manner.

Because the supporting members can also be clipped in the carrier, as described above, they can be retained on the carrier in axial direction and thus be held very reliably on the carrier, which considerably reduces the risk of uncontrolled slippage or falling out of the containers from the carrier. This holds particularly when also the supporting members themselves are configured such that the containers are retained in axial direction in the receptacles of the supporting members. This can be realized in a simple manner by suitable design of the positive-fit in the retaining receptacles.

Preferably, the supporting members are clipped in the carrier on the upper surface of the carrier so that the upper ends of the containers, particularly the filling apertures provided therein, are easily accessible for further processing of the containers, for example for filling or sealing the containers. In these arrangements the edges of the apertures also serve as a collision protection in order to prevent a collision of directly adjacent containers. However, according to a further embodiment, the supporting members can also be clipped on the underside of the carrier in the latter, so that the upper ends of the containers protrude from the apertures up to the upper side of the carrier.

According to a further embodiment, the supporting members are each formed as ring-shaped or annular supporting members to surround the outer periphery of the containers in a positive-fit manner, wherein the supporting members are clipped into the apertures of the carrier in each case directly or by means of a respective clip. Thus, a compensation of tolerances and a flexible supporting of vials with different outer contours and dimensions is more easily accomplished. The annular supporting member surrounds the outer periphery of the container at least partially and more preferably substantially completely, possibly with the exception of an insertion aperture for inserting and removing the containers into or out from the annular supporting member.

The engagement of the supporting member is implemented in a particularly flexible and easy manner in the region of a constricted neck portion of the container, which is embraced by the supporting member at least partially.

According to a further preferred embodiment, the supporting members each have a plurality of receptacles, which are arranged distributed at uniform intervals from one another and along the respective supporting member, to thereby specify a regular array of the containers, which facilitates an automated handling or processing of the containers. The supporting members are each clipped into the carrier. Hence, the supporting members can be releasably connected to the carrier, but held reliable in this clipped-in condition.

Most preferably, the container is respectively accommodated with a radial clearance in the receptacles of the supporting member, the inner diameters of which are larger than the outer diameters of the constricted neck portions but smaller than the outer diameters of upper rims of the containers, which adjoin the constricted neck portions. In particular, when the underside of the upper rim (and in particular of the so-called rolled edge) of the container is slanted, an automatic self-centering effect results, so that the container is centered automatically when it is accommodated in the central aperture of the supporting member.

The handling of the supporting members can be facilitated if these comprise a slanted edge in the region of the holding clips provided on the edges, which allows the formation of a wedge-shaped free space into which a gripping or handling tool can be inserted in order to grip or handle the supporting member and to release again the clip-coupling with the carrier.

According to further embodiments, the inner edges of the circular receptacles of the respective supporting member may be slanted, which results in an additional self-centering effect of the containers, when these rest on the edge of the associated aperture. This holds in particular, when the friction between the annular supporting member and the container is advantageously low because of the suitable friction pairing of these elements, so that the weight of the containers or a slight shaking is sufficient to effect automatically this self-centering of the containers.

According to a further embodiment, at least one predetermined breaking point or at least one weakening zone is provided in the supporting member in order to break apart the supporting member. Thus, smaller subunits can be obtained from the supporting member in a simple manner by breaking the smaller subunits, which support one container or relatively few containers and thus can be processed more easily or can be inserted into special transport and packaging containers.

According to a further embodiment, the supporting members comprise identification or tracking means for identifying or tracking the supporting structure with the containers supported by it and/or a sensor for monitoring parameters of the supporting structure, for example, ambient parameters such as temperature, light conditions or moisture, as a function of time or to monitor and control such parameters as a function of time. For this purpose, the identification or tracking means and/or the sensors are preferably embedded in the supporting members formed of a plastic material, for example in the ring-shaped receptacles.

A further aspect of the present invention relates to a transport or packaging container for a plurality of containers for substances for medical, pharmaceutical or cosmetic applications, comprising a box-shaped container in which at least one supporting structure, as set forth above, is accommodated for concurrently supporting the plurality of containers in the transport or packaging container.

OVERVIEW ON DRAWINGS

Figure 2B:
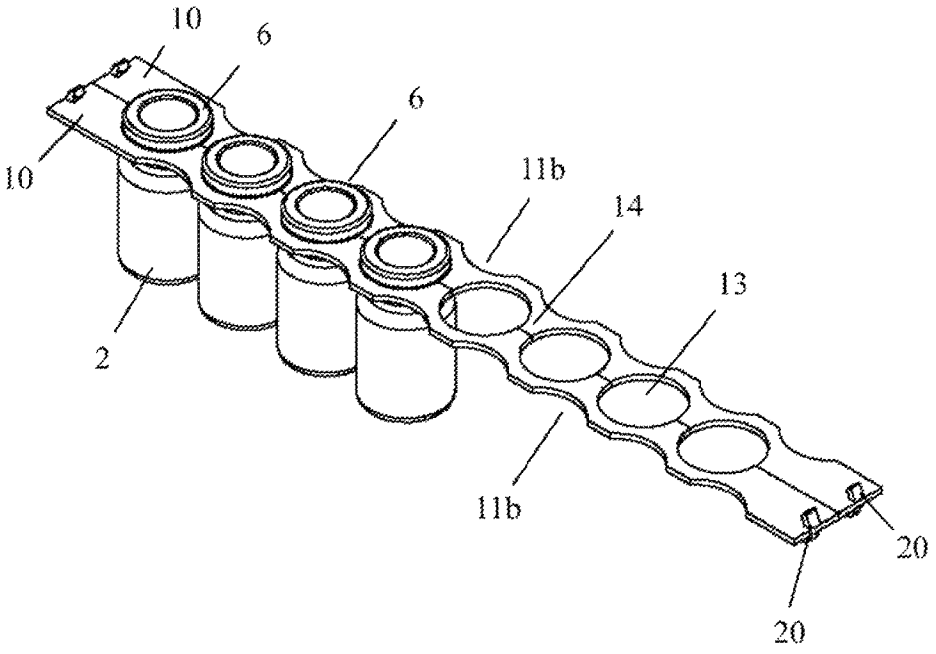
Figure 2A:
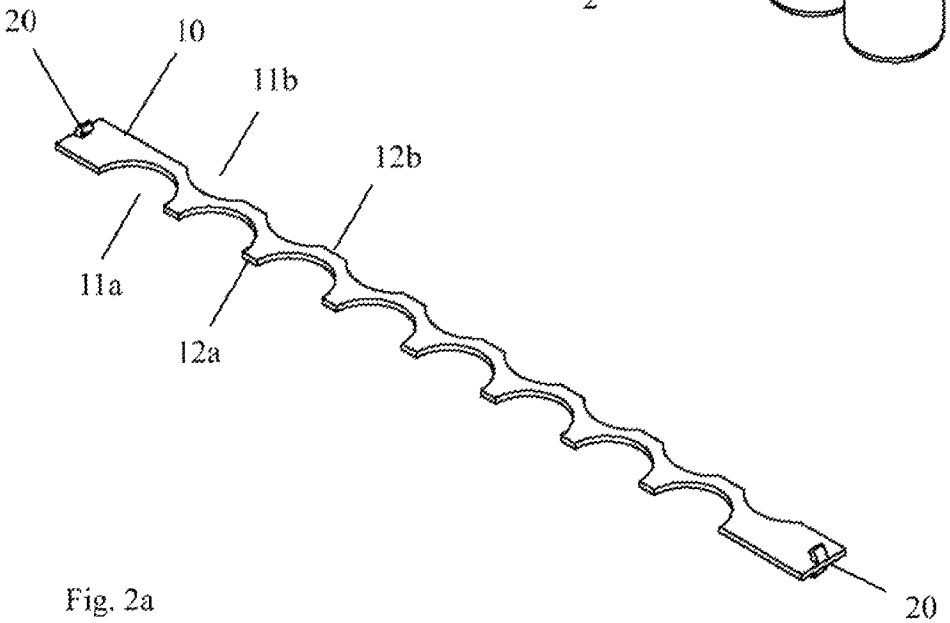
Figure 2C:
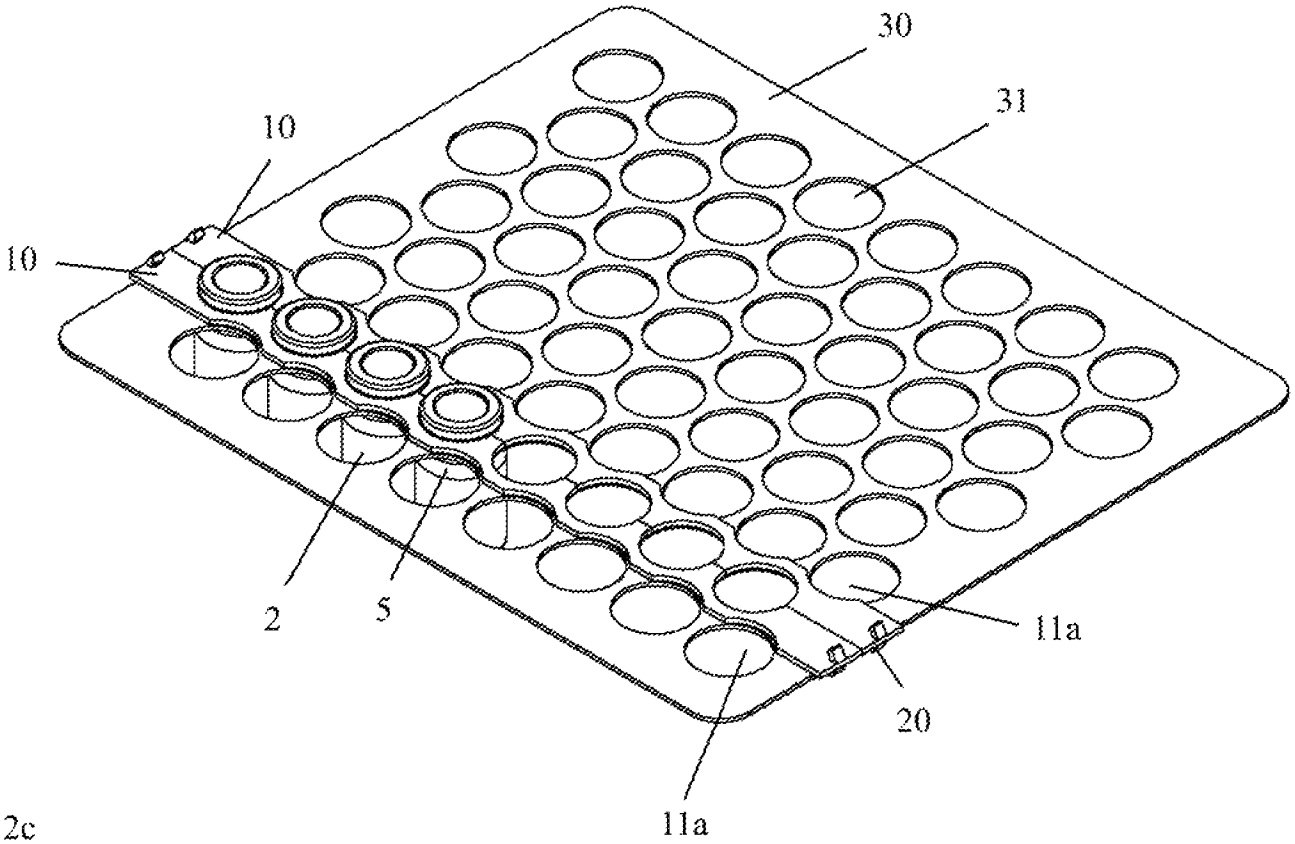

The invention will now be described by way of example and with reference to the accompanying drawings, from which further features, advantages and problems to be solved will become apparent. In the drawings:

FIG. 1 is a schematic sectional view of a vial, which is to be supported by a supporting structure according to the present invention;

FIG. 2*a* is a perspective plan view of a strip-shaped supporting plate, which forms one half of a supporting member according to a first embodiment of the present invention;

FIG. 2*b* is a perspective plan view of a supporting structure (supporting plate), which is formed by two strip-shaped supporting plates according to FIG. 2*a* having a plurality of vials (containers) supported therein;

FIG. 2*c* a supporting structure according to the present invention having two strip-shaped supporting plates according to FIG. 2*a*, which are clipped into a carrier for concurrently supporting a plurality of vials.

Figure 2D:
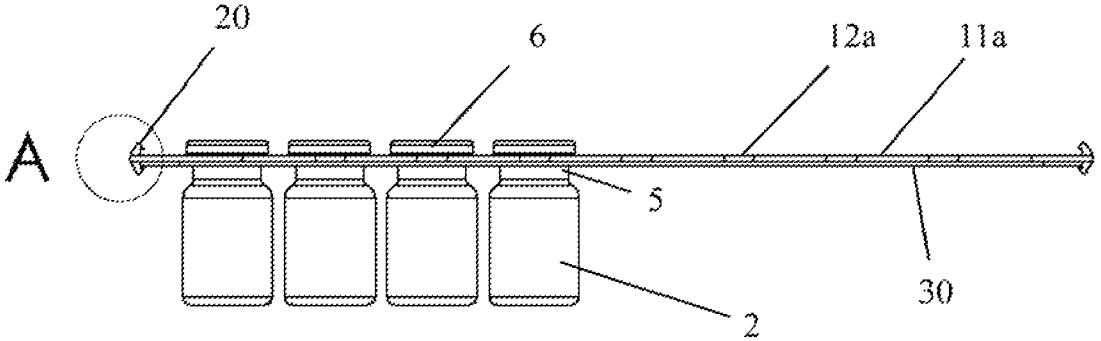

FIG. 2*d* is a sectional view of the supporting structure shown in FIG. 2*c*.

Figure 2E:
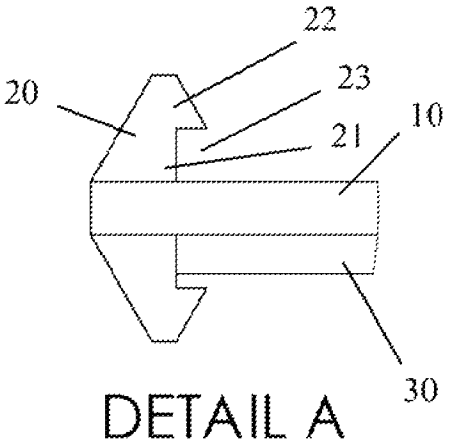

FIG. 2*e* shows an enlarged partial view of a holding clip of the supporting structure of FIG. 2*d;*

Figure 2F:
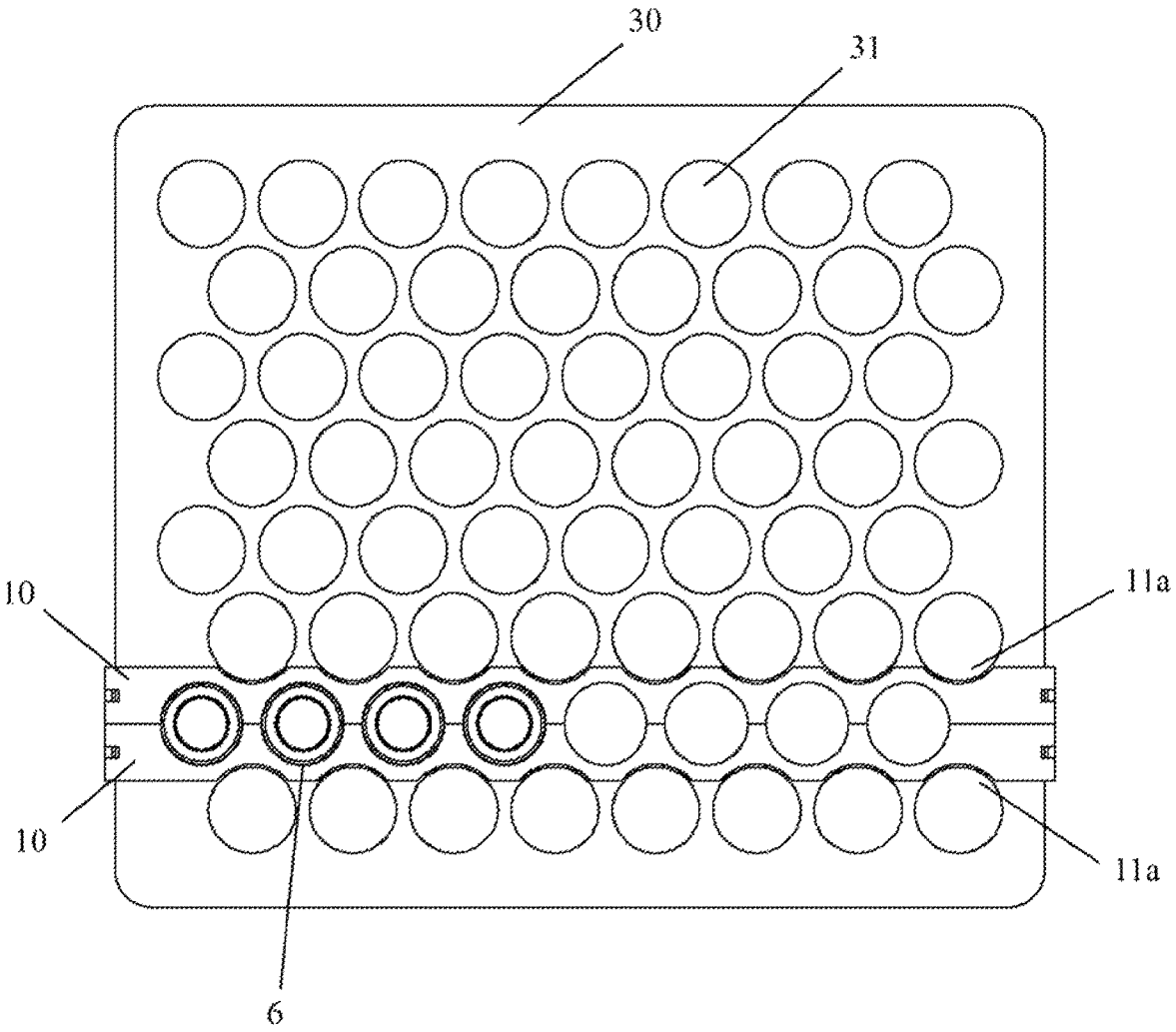

FIG. 2*f* is a plan view of the supporting structure (carrier) according to FIG. 2*c;*

Figure 3A:
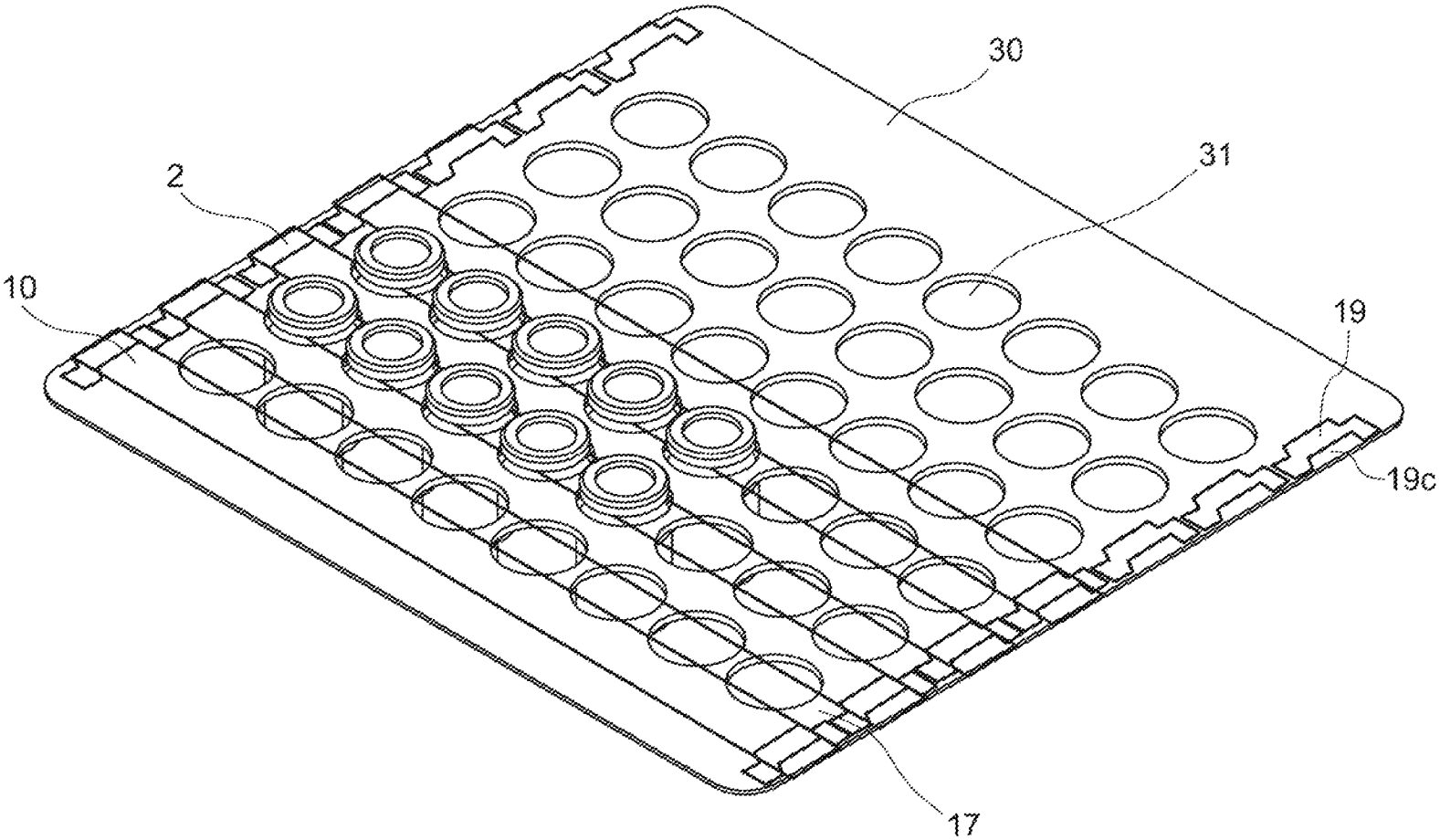
Figure 3B:
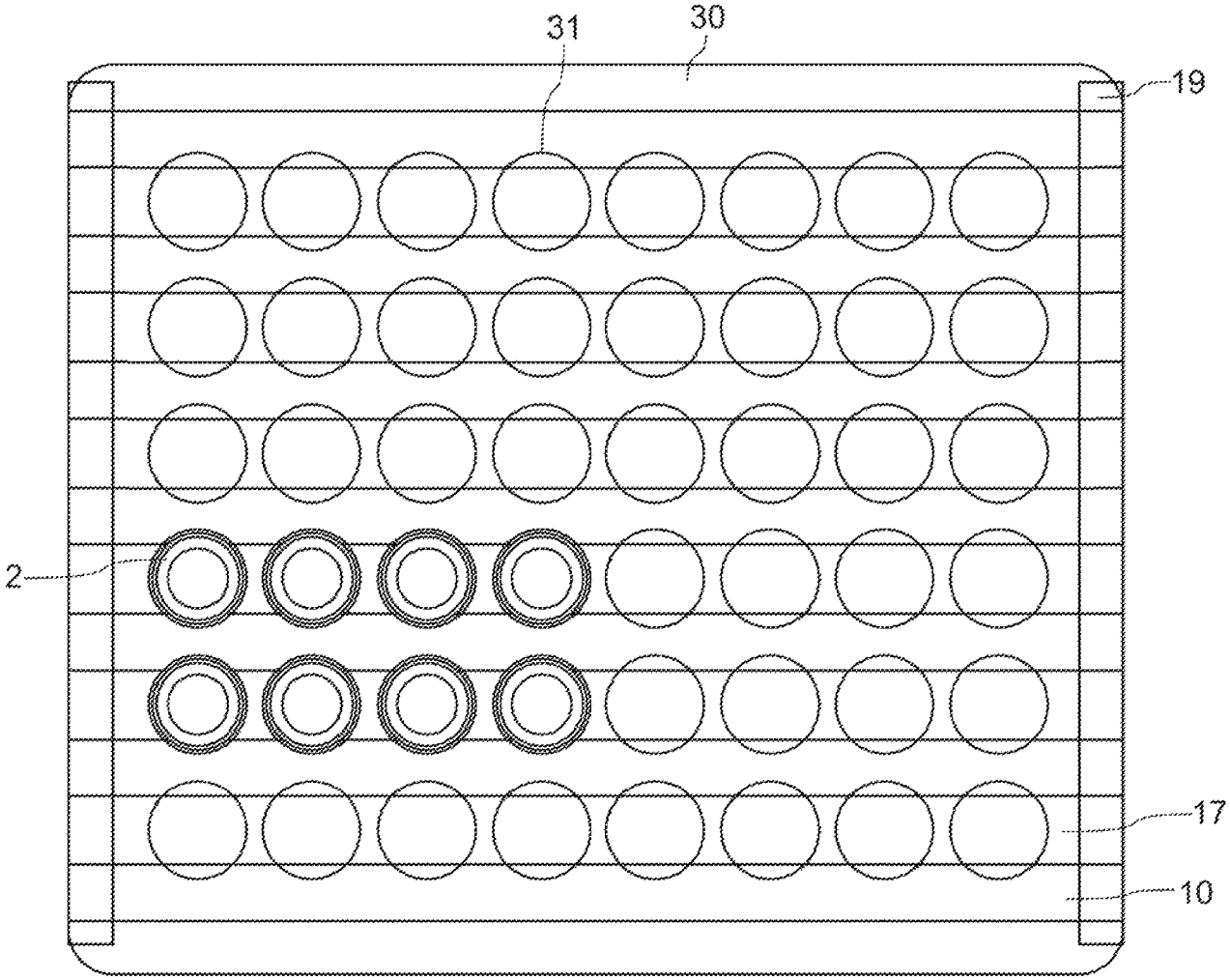
Figure 3C:
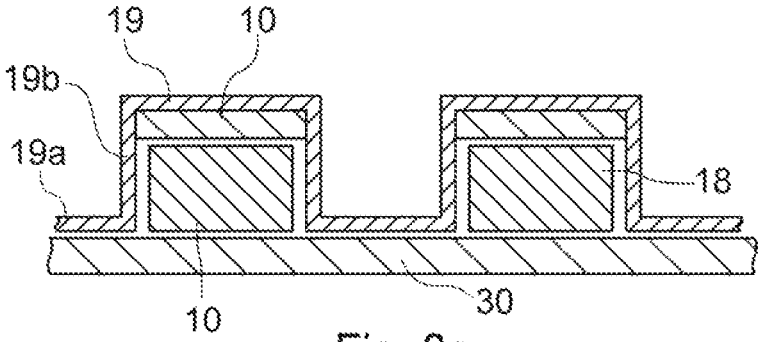

FIGS. 3*a* and 3*b* are a perspective view and a plan view of a supporting structure according to a further embodiment of the present invention;

FIG. 3*c* is a sectional view along C-C at the edge of the supporting structure of FIG. 3*b*.

Figure 4A:
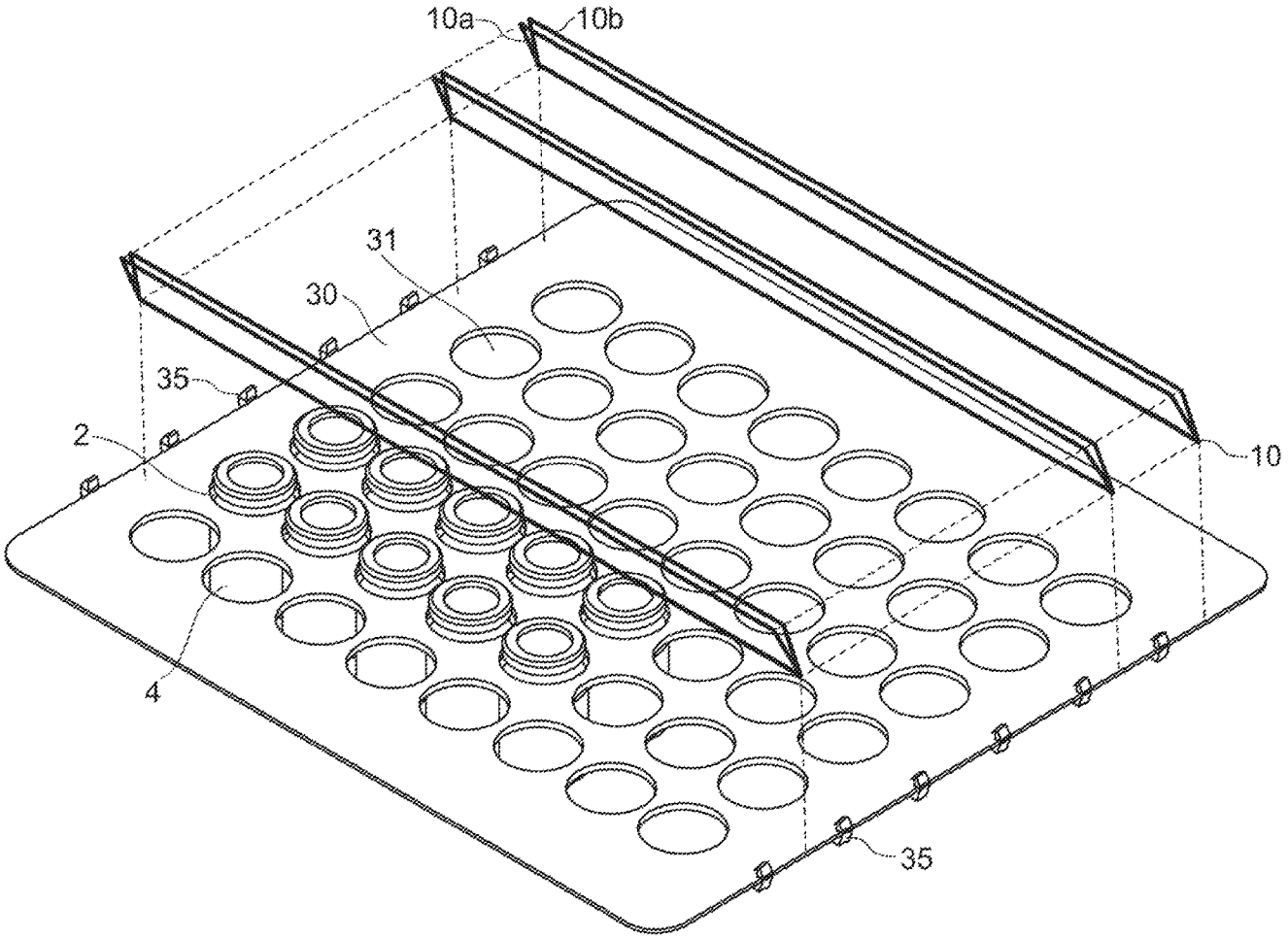
Figure 4B:
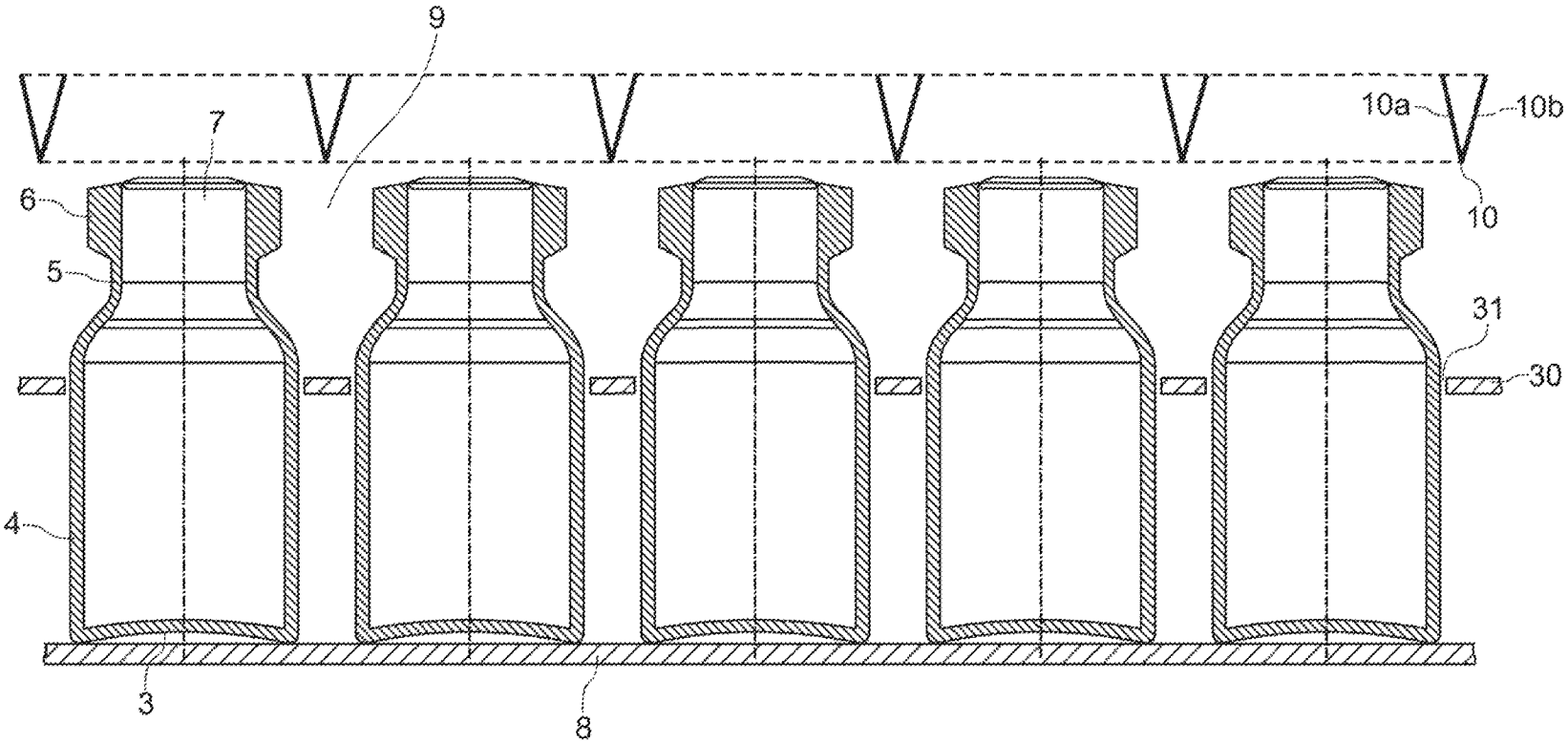

FIGS. 4*a* and 4*b* show a supporting structure according to a further embodiment of the present invention in a side view and in a schematic perspective view and in a state before the containers are supported on the supporting structure.

Figure 4C:
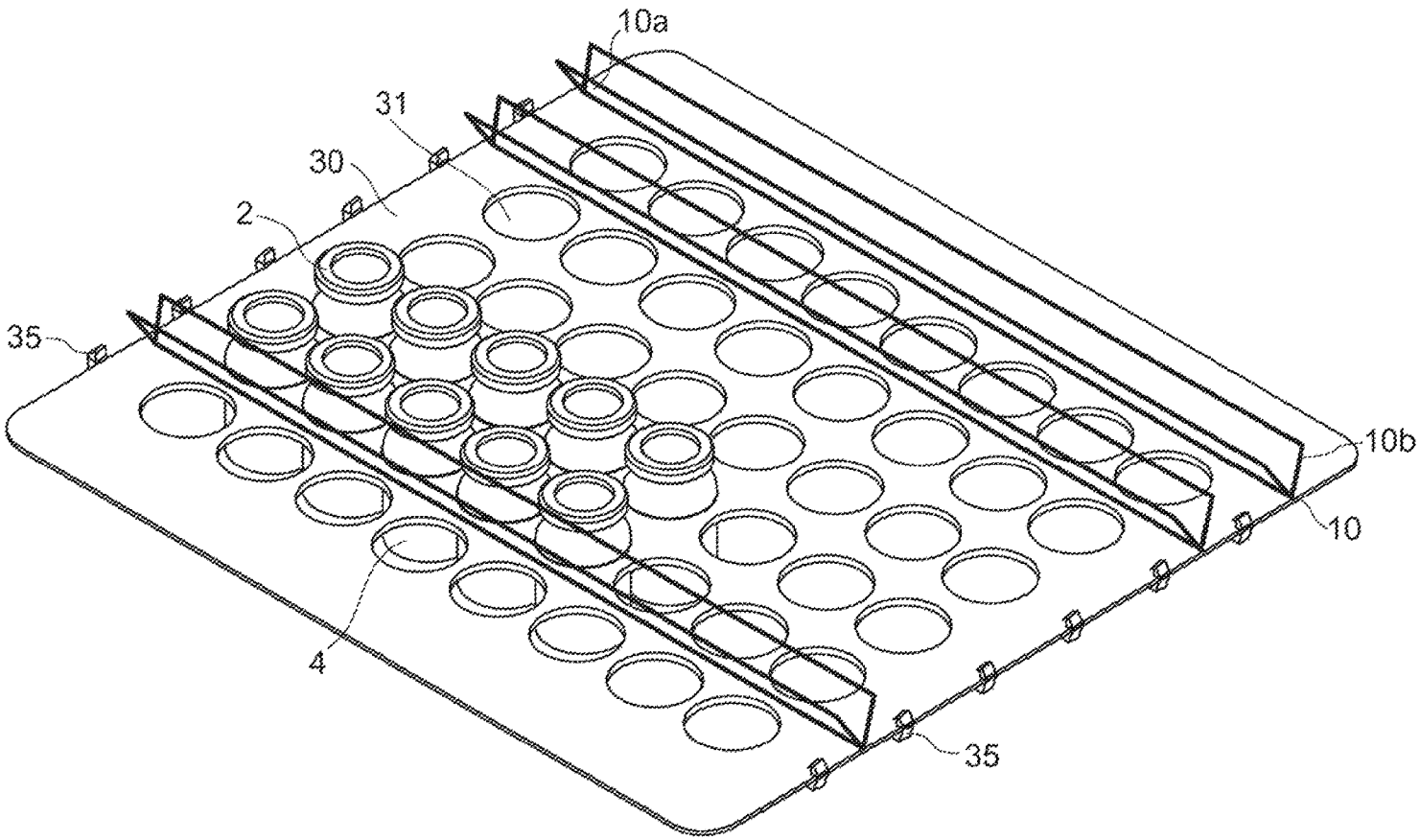
Figure 4D:
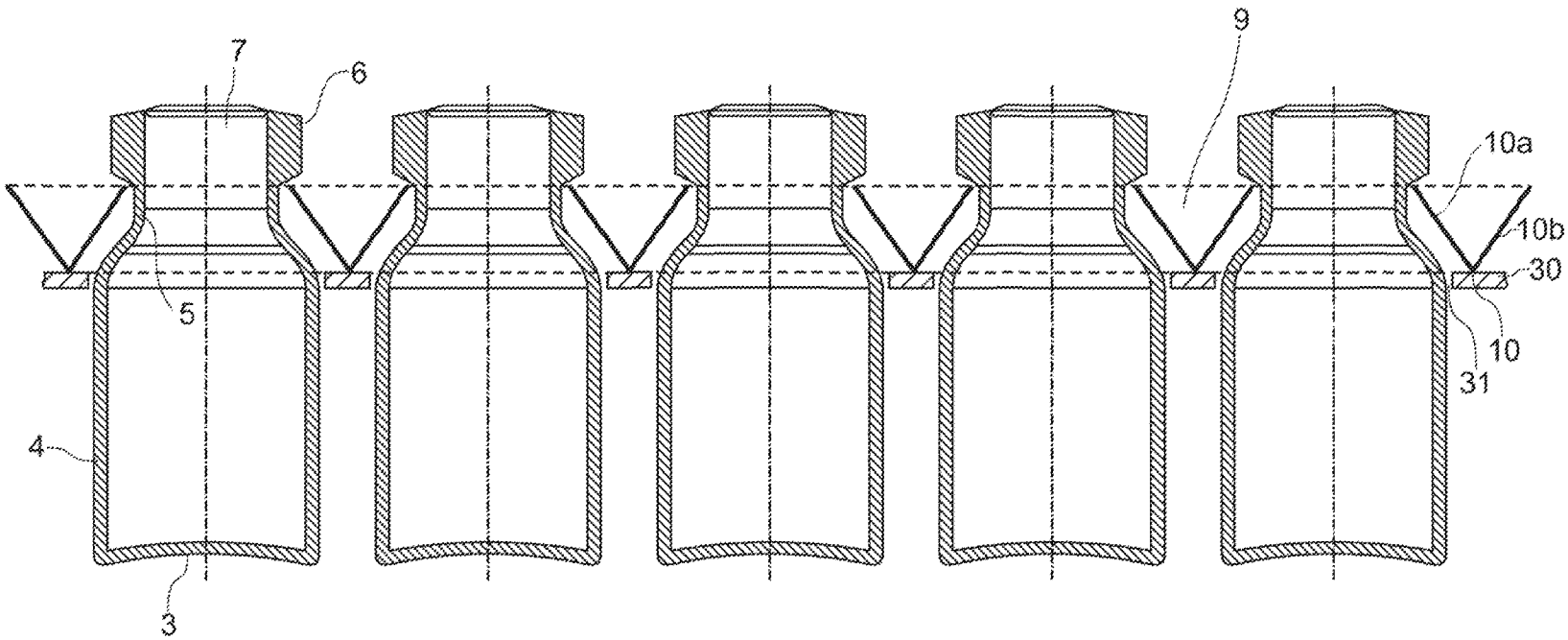

FIGS. 4*c* and 4*d* show the supporting structure according to FIGS. 4*a* and 4*b* in a side view and a schematic perspective view and in a state in which the containers are supported by the supporting structure.

Figure 5A:
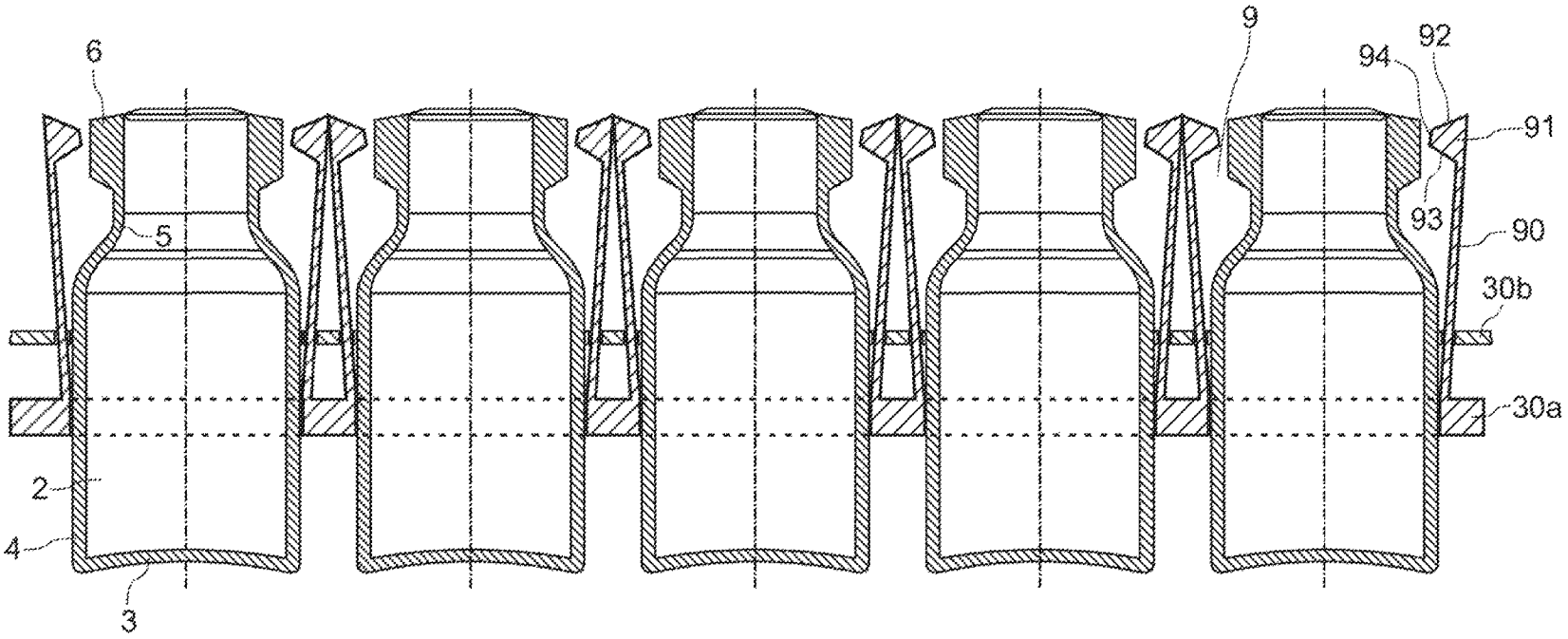
Figure 5B:
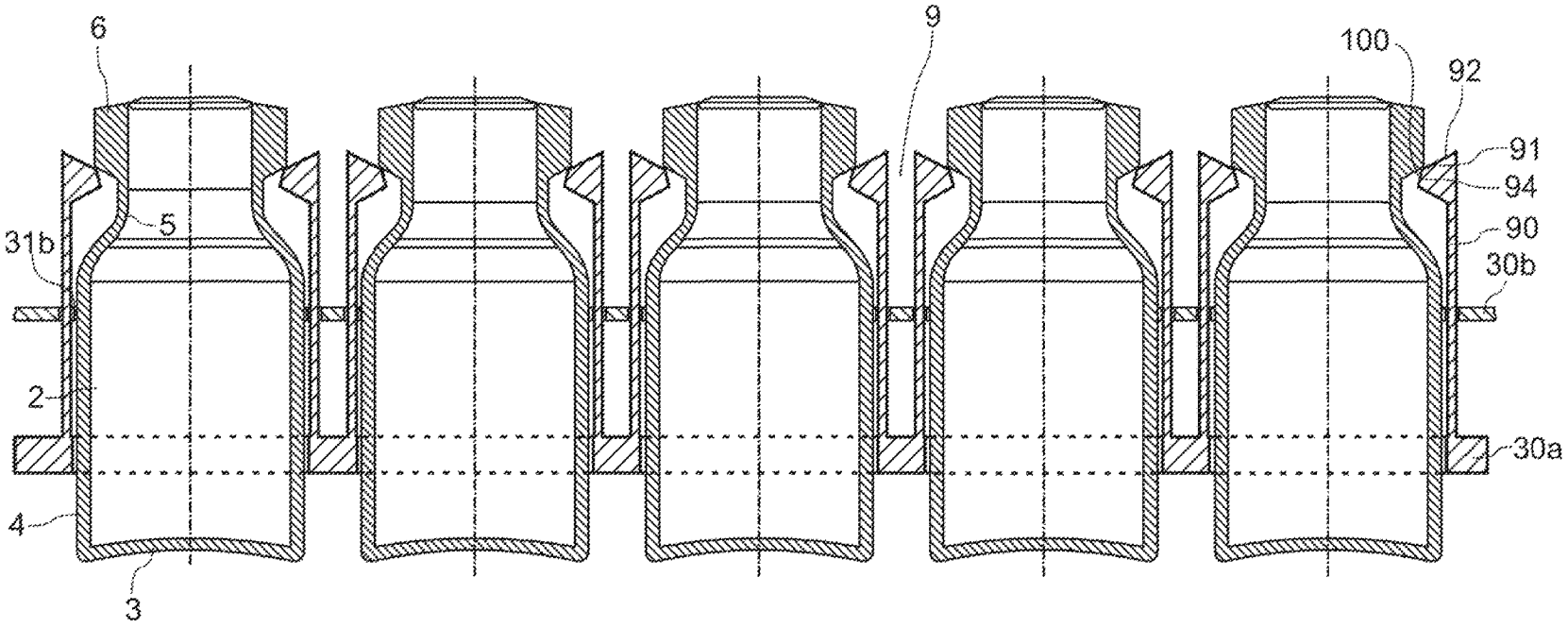

FIGS. 5*a* and 5*b* show in a schematic sectional view a supporting structure according to a further embodiment of the present invention in a state before the containers are supported on the supporting structure, and in a state in which the containers are supported on the supporting structure.

Figure 5C:
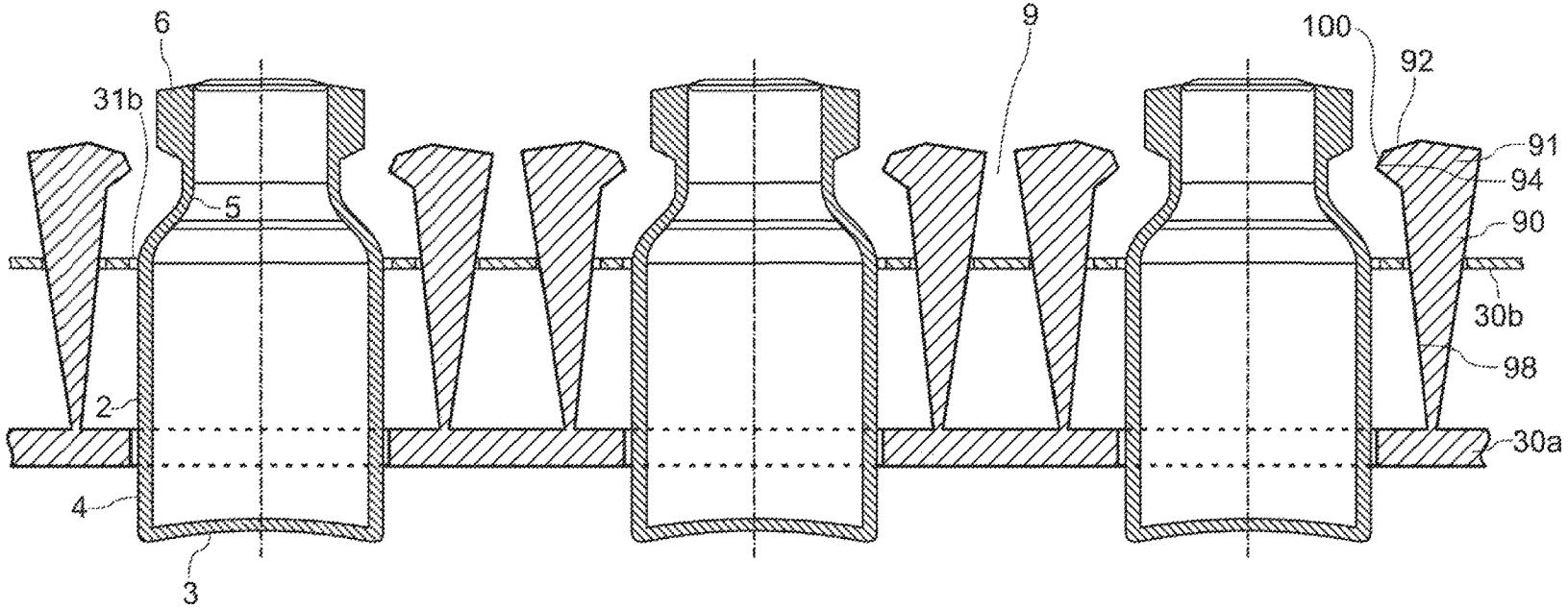
Figure 5D:
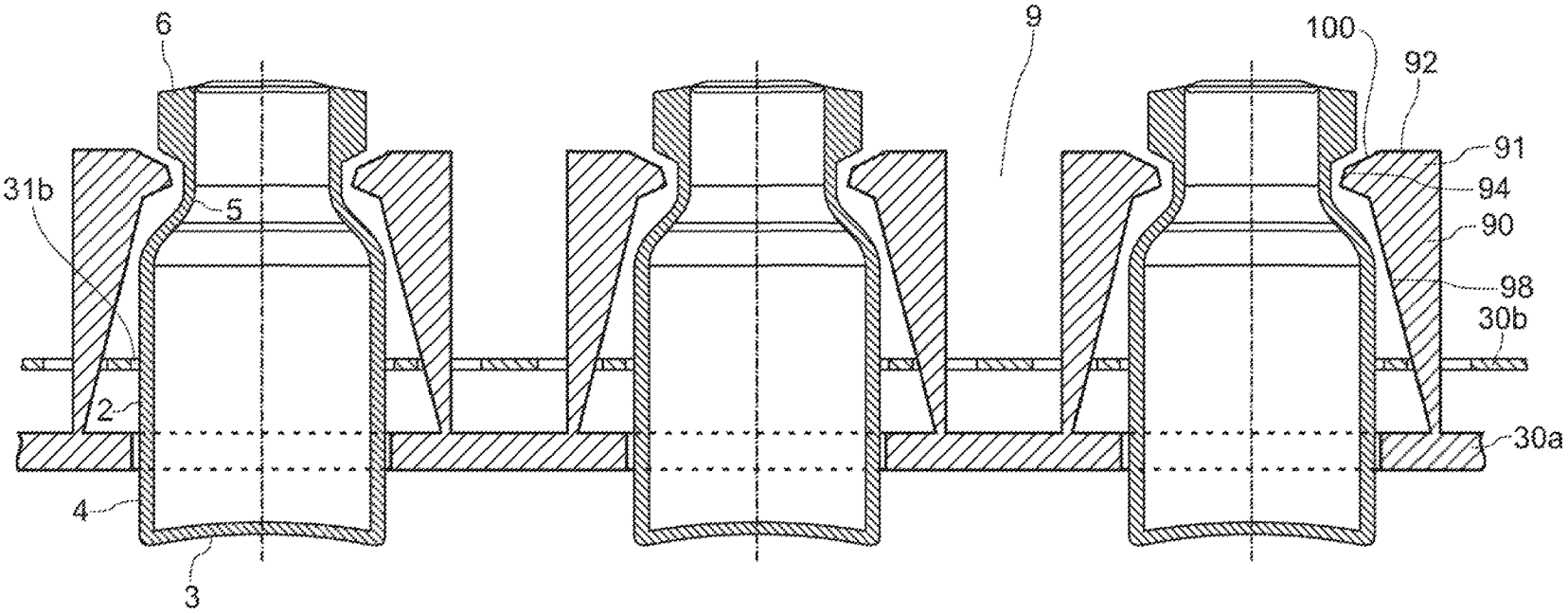

FIGS. 5*c* and 5*d* show in a schematic sectional view a supporting structure according to a further embodiment of the present invention in a state before the containers are supported on the supporting structure, and in a state in which the containers are supported on the supporting structure.

FIGS. 6*a* to 6*d* show in a perspective view, a plan view, a sectional view and a greatly enlarged partial sectional view a supporting structure according to a further embodiment of the present invention in a state before the containers are supported on the supporting structure.

Figure 7A:
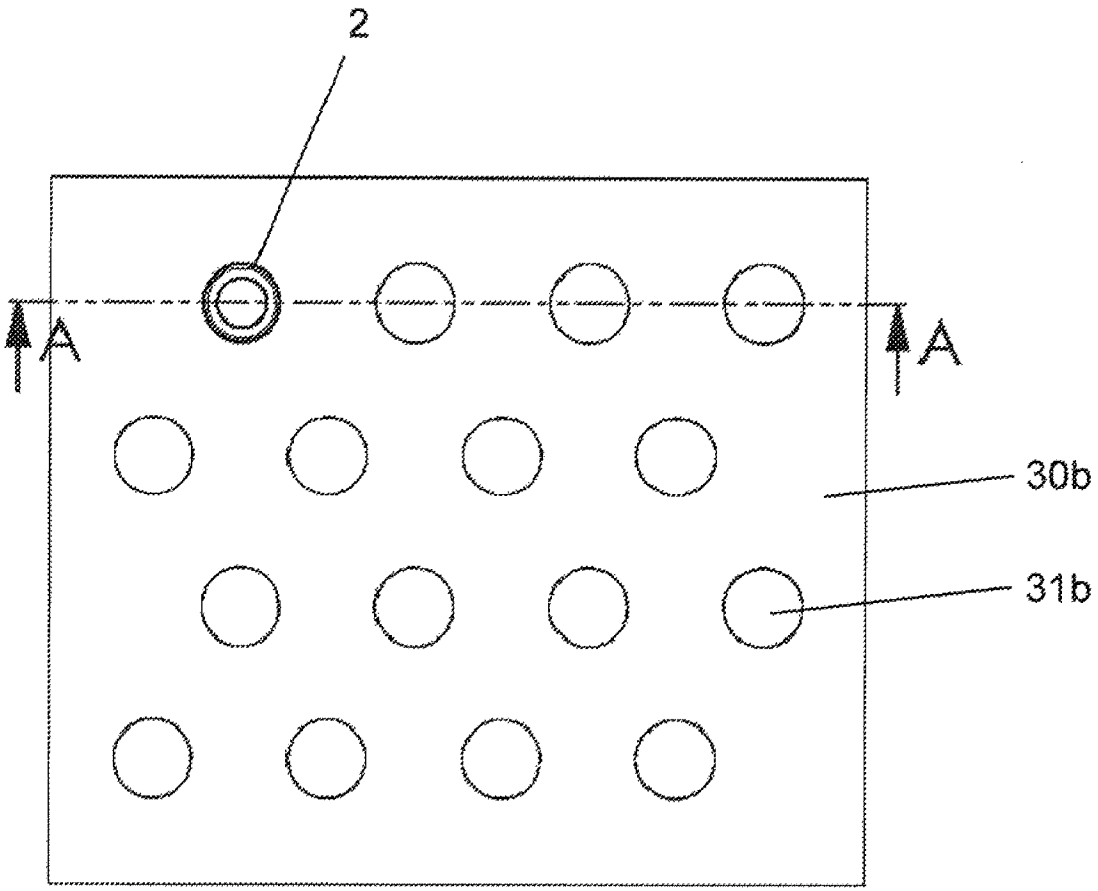
Figure 7B:
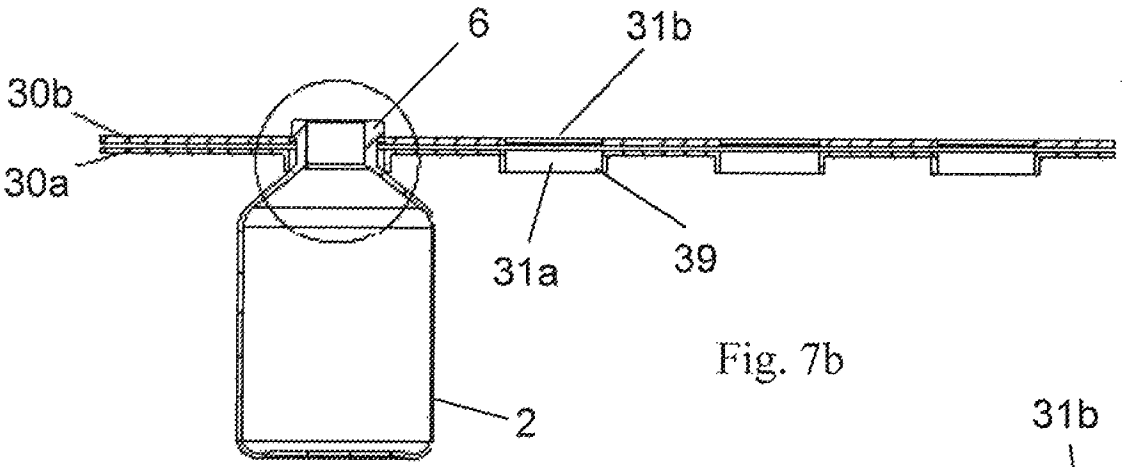
Figure 7C:
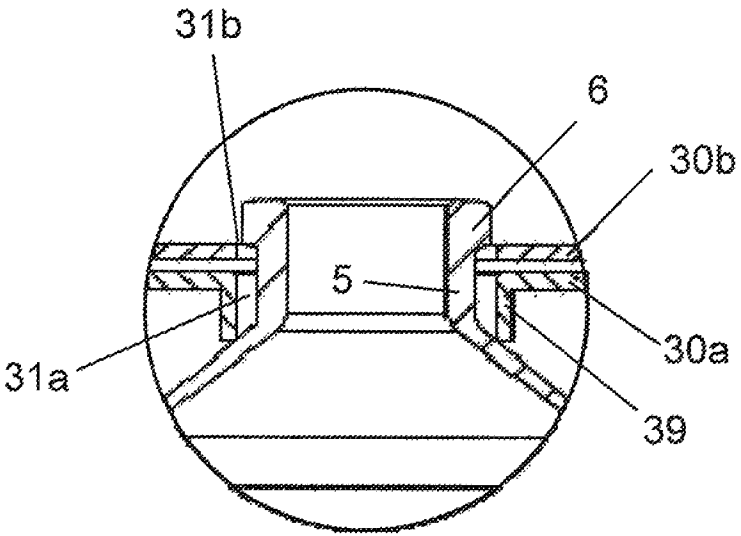

FIGS. 6*e* to 6*k* show the supporting structure according to FIGS. 6*a* to 6*d* in other phases of assembling the supporting structure;

FIGS. 7*a* to 7*c* show in a top view, a sectional view and a greatly enlarged partial sectional view a supporting structure according to a further embodiment of the present invention in a state before the containers are supported on the supporting structure.

Figure 7D:
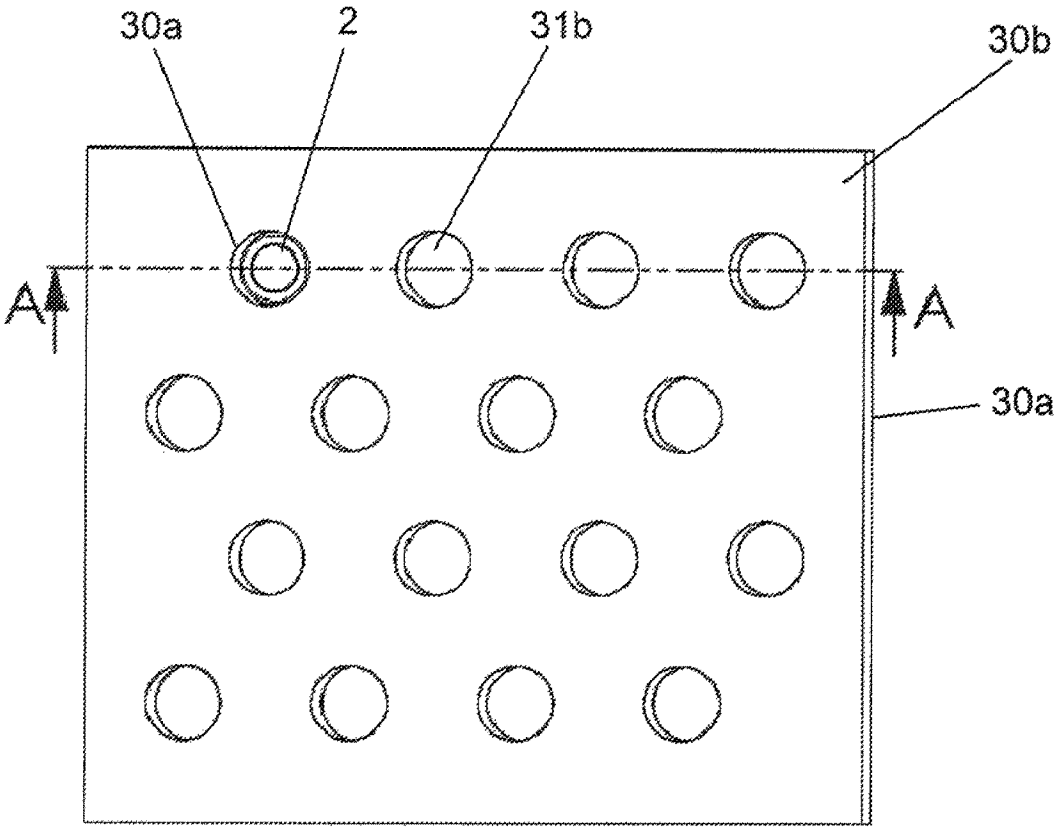
Figure 7E:
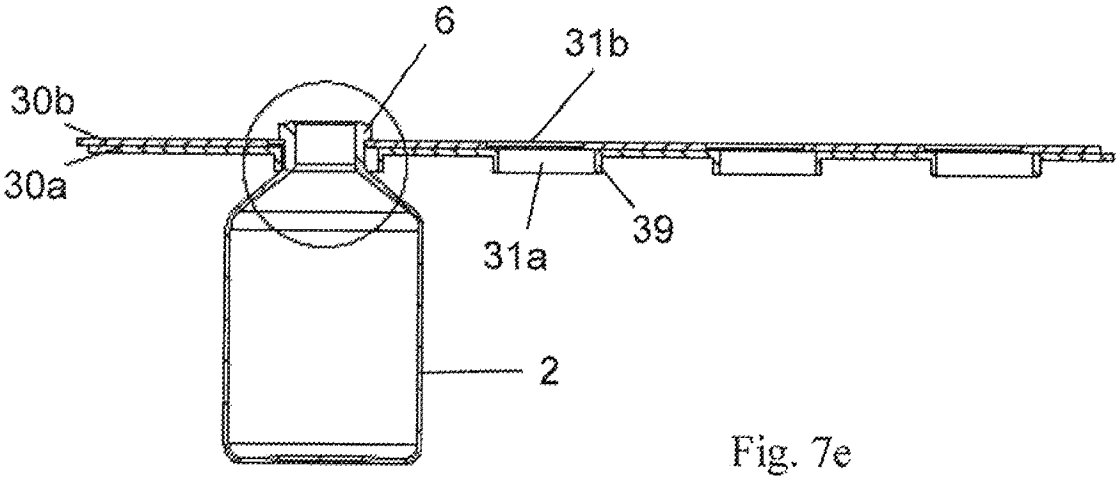
Figure 7F:
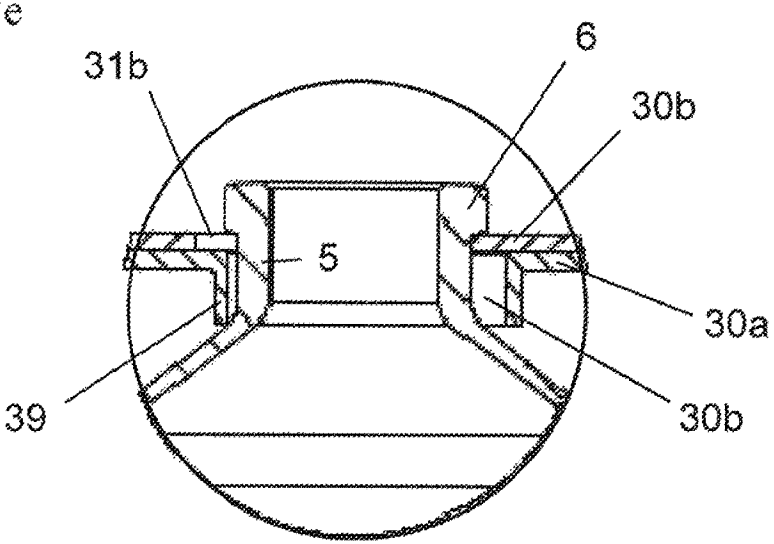
Figure 8A:
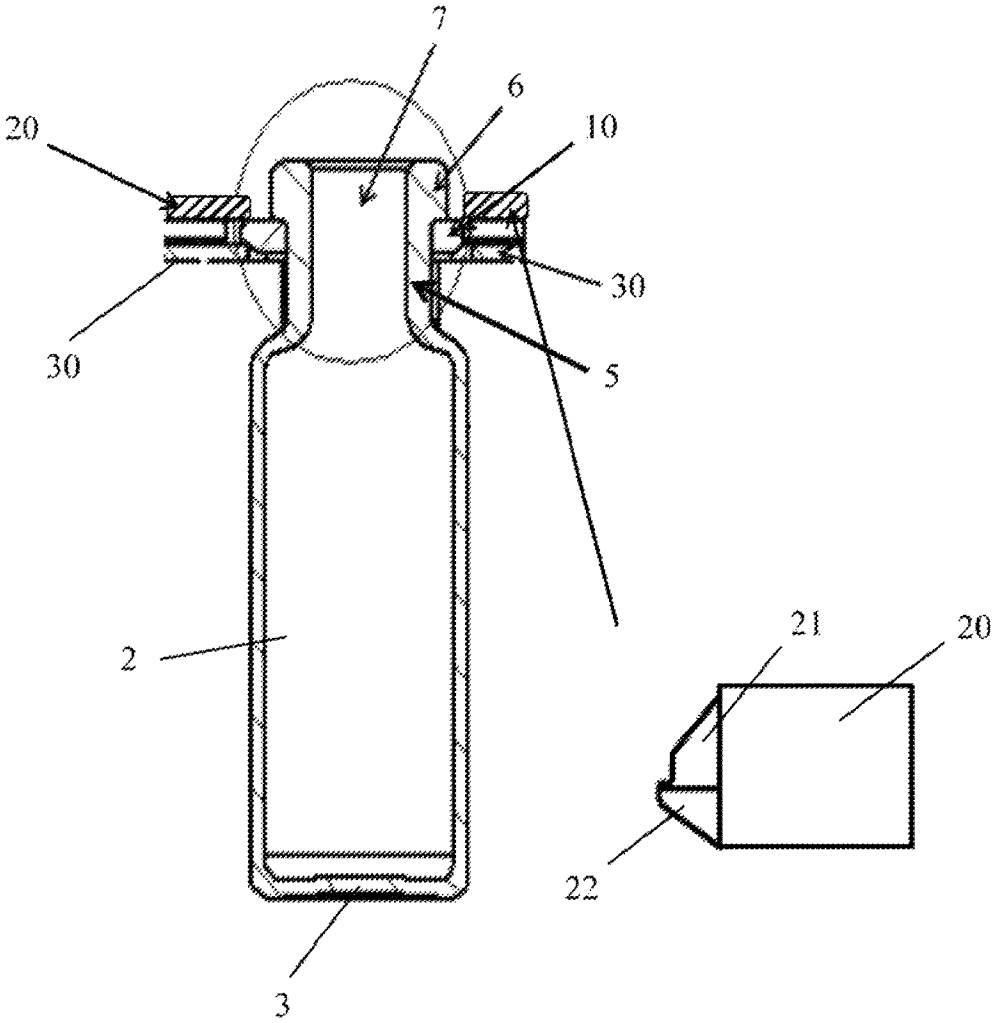

FIGS. 7*d* to 7*f* show in a plan view, a sectional view and a greatly enlarged partial sectional view a supporting structure according to the embodiment of FIGS. 7*a* to 7*c* in a state in which the containers are supported on the supporting structure;

FIG. 8*a* shows in a schematic sectional view the supporting of a vial in a variant of the supporting structure of FIG. 2*c;*

Figure 8B:
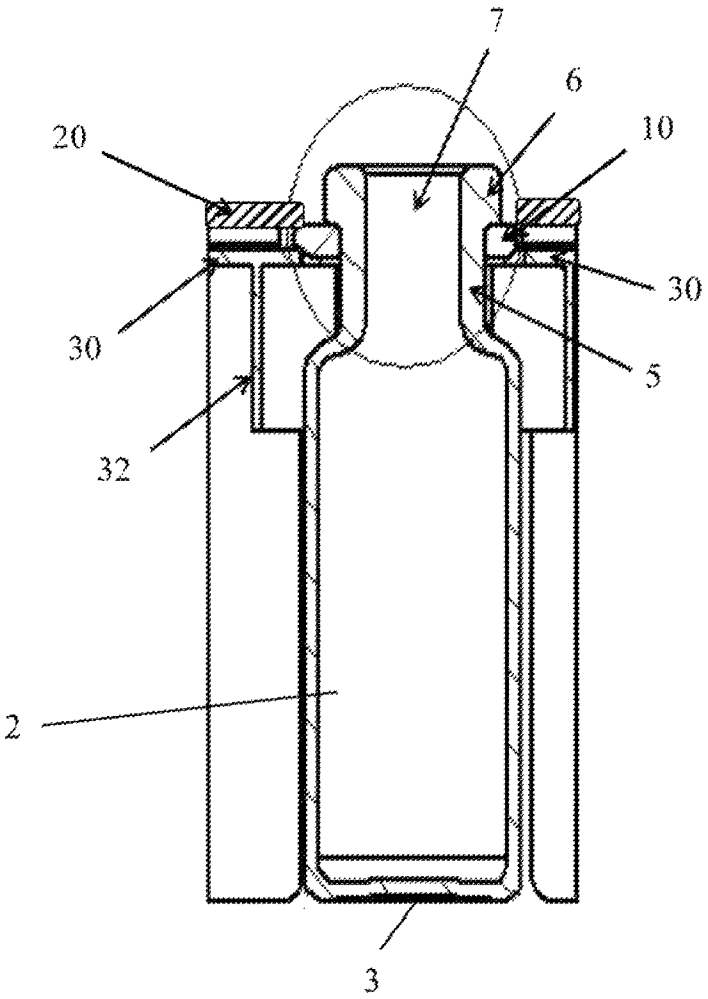

FIG. 8*b* is a schematic sectional view the supporting of a vial in a further variant of the supporting structure of FIG. 2*c*.

Figure 8C:
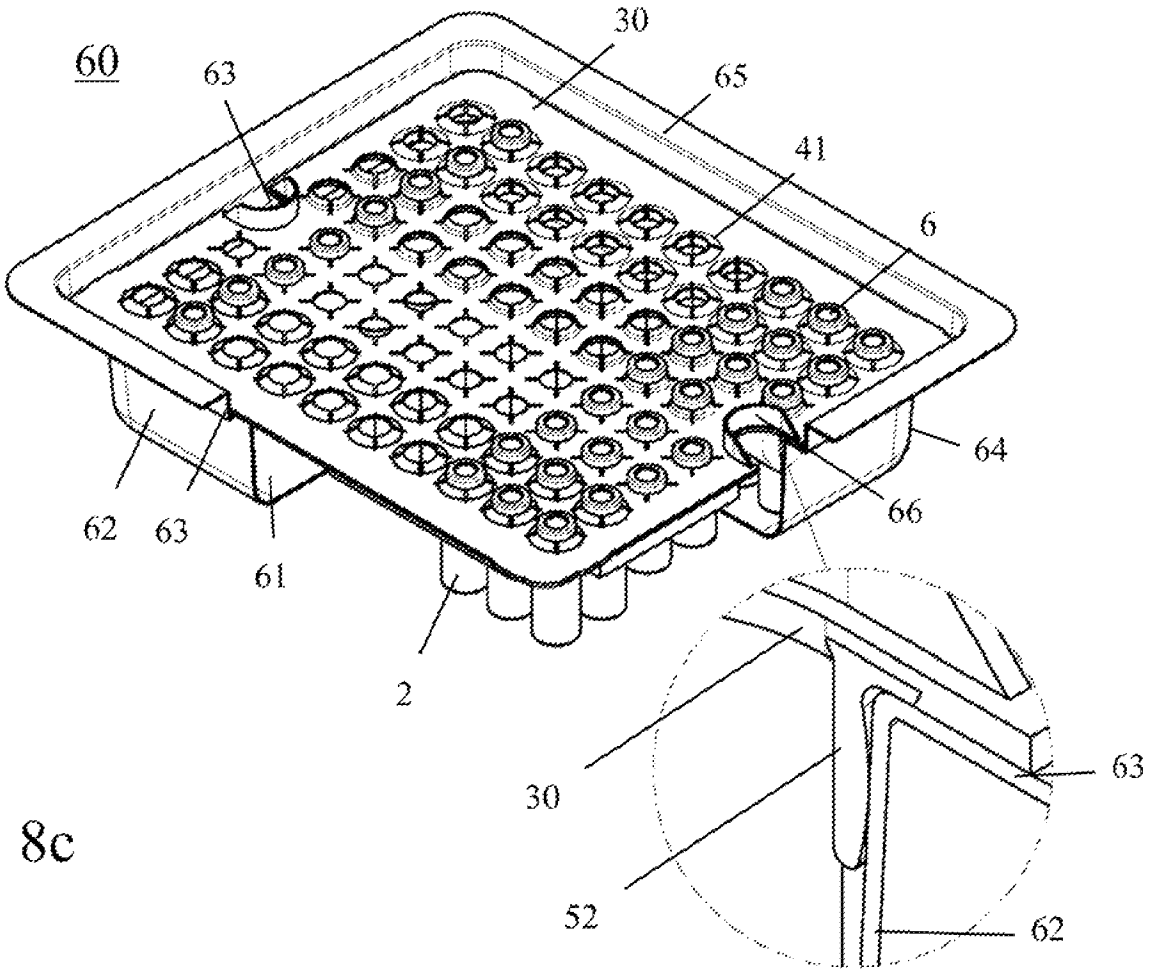

FIG. 8*c* shows in a perspective top view and a greatly enlarged partial sectional view a transport and packaging container with an exemplary supporting structure having identification and tracking means or having provisions for an anti-counterfeiting protection.

Figure 9A:
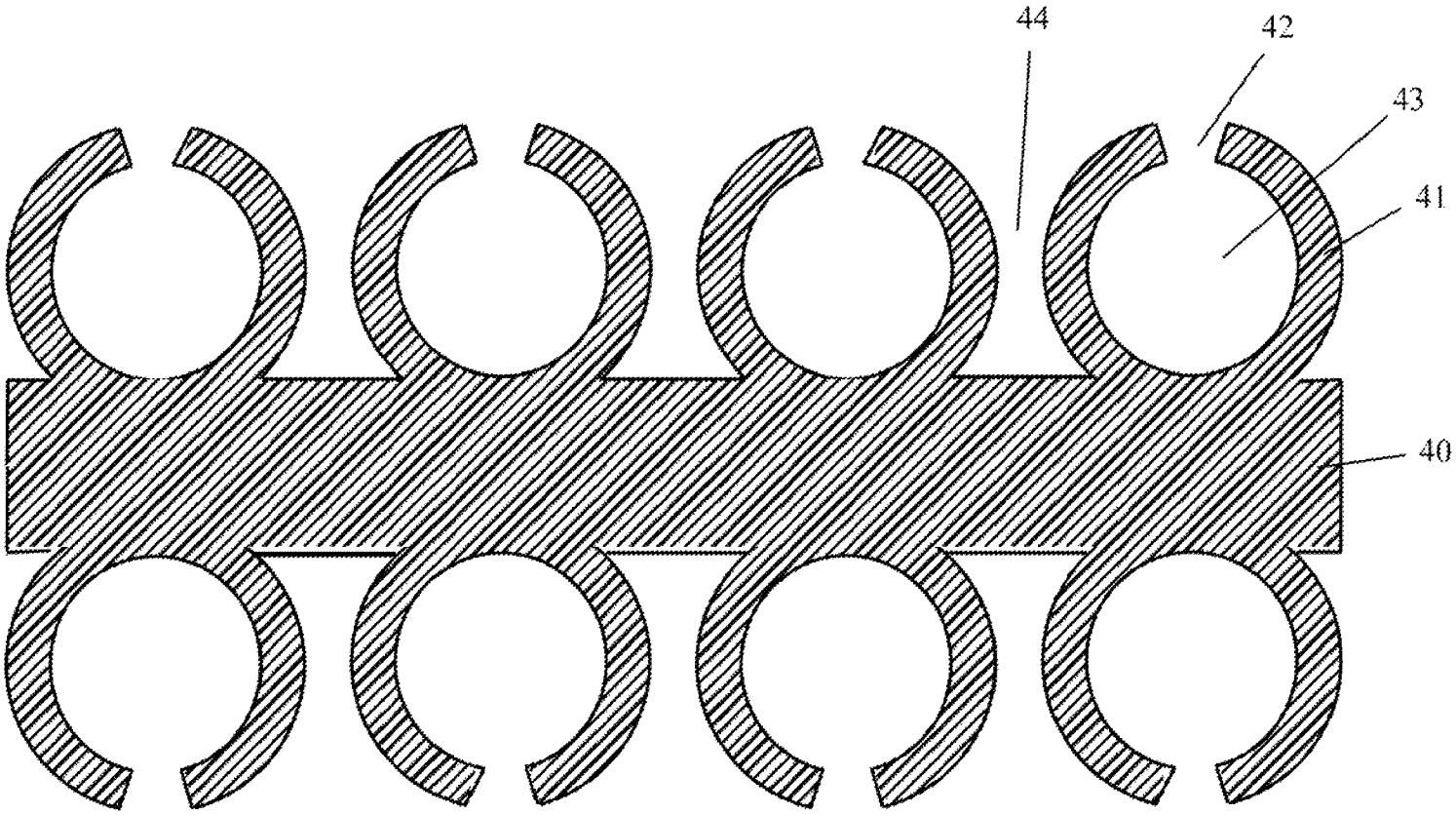
Figure 9B:
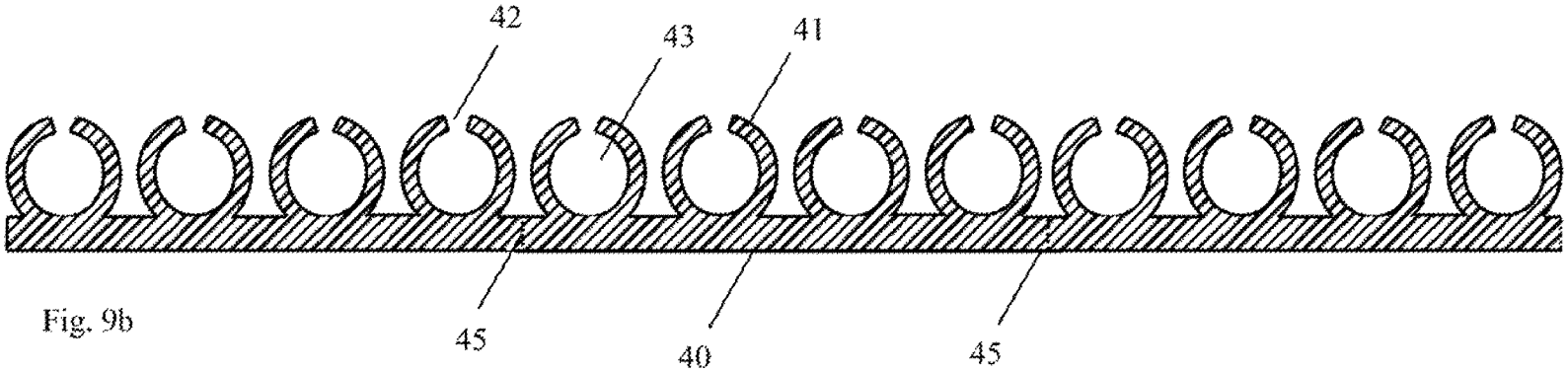
Figure 9C:
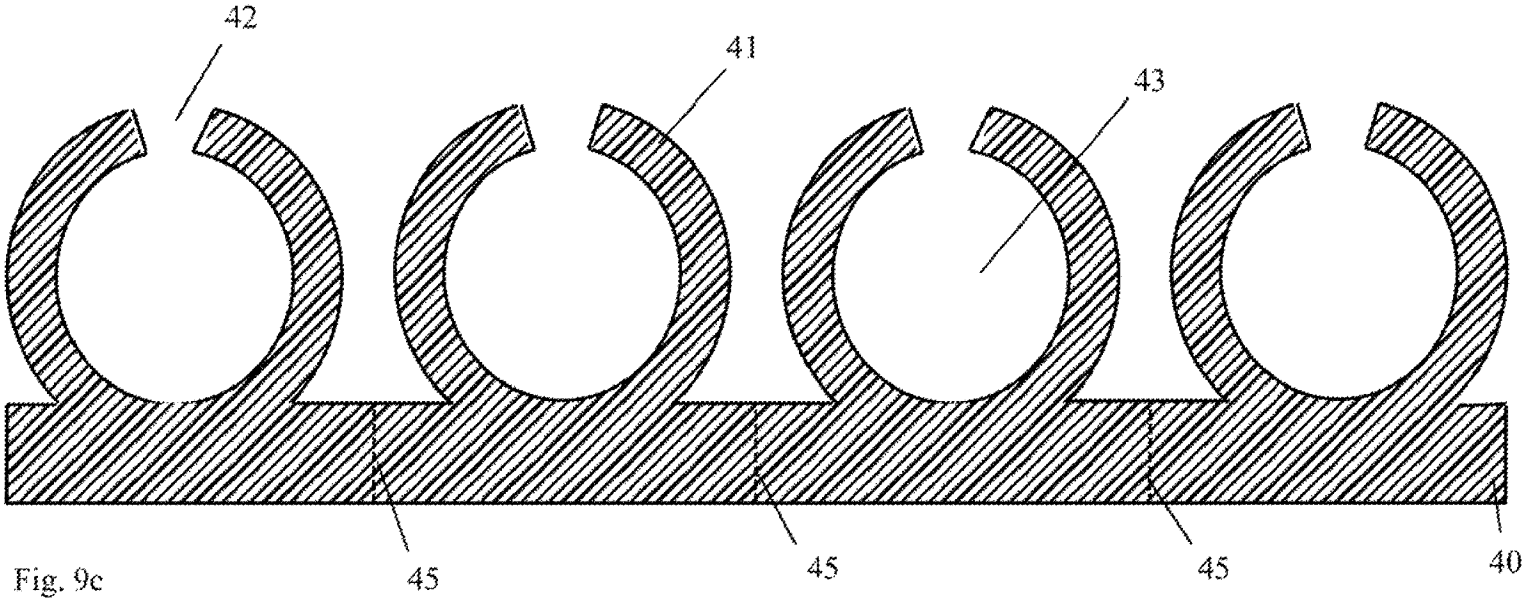
Figures 9D, 9E, 9F:
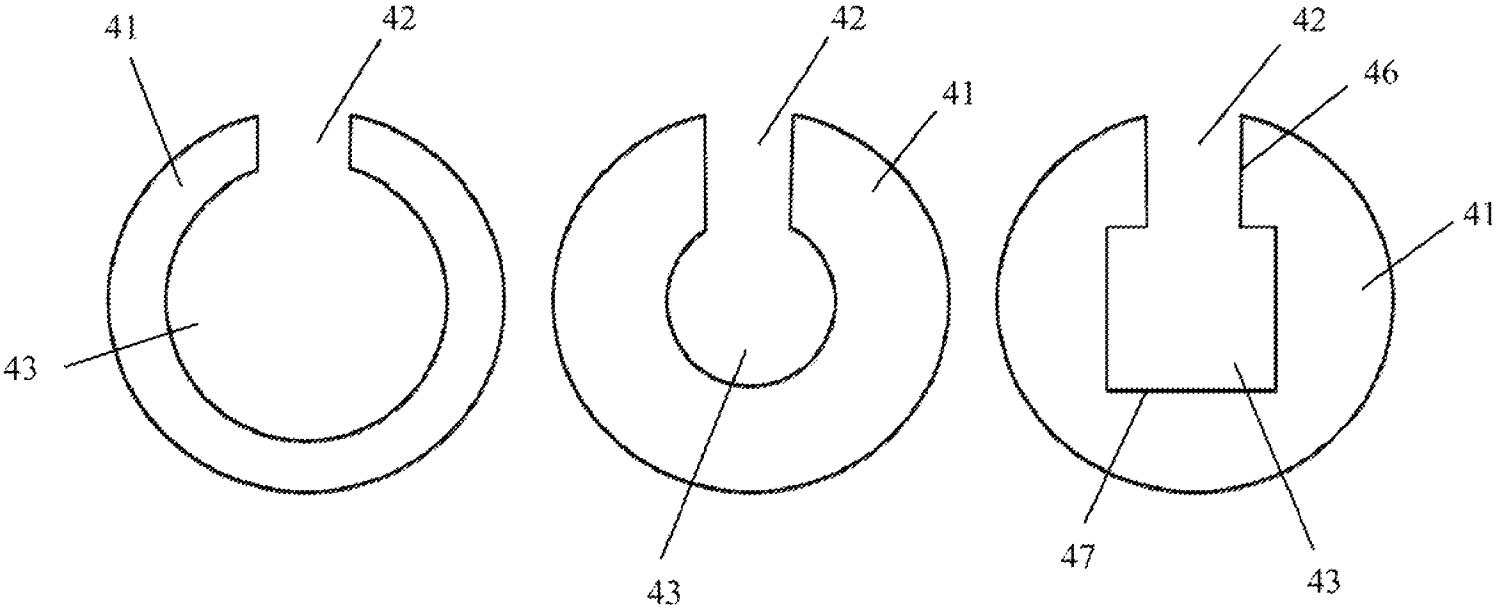

FIGS. 9*a* to 9*c* are plan views of supporting members according to further embodiments according to the present invention; and FIGS. 9*d* to 9*f* show three examples of annular supporting receptacles in such supporting means.

In the drawings, identical reference numerals designate identical or substantially equivalent elements or groups of elements.

DETAILED DESCRIPTION OF PREFERRED EMBODIMENTS

According to the present invention, a supporting structure as well as a transport and packaging container accommodating such a supporting structure are used, as described below, for concurrently supporting a plurality of containers for storage of substances for medical, pharmaceutical or cosmetic applications in an array configuration, preferably in a matrix configuration with regular intervals between the containers along two different directions in space, preferably along two mutually orthogonal directions in space or in regular rows that are offset relative to each other.

An example of such containers embodied as vials is schematically shown in FIG. 1 in a longitudinal sectional view. The vials have a cylindrical basic shape, having a cylindrical side wall 4 with—within tolerances—constant inner and outer diameters, which project vertically from a flat vial bottom 3, which merges in a constricted neck portion 5 of a relatively short axial length near the upper open end of the vial and then merges in an expanded upper rim 6 (also referred to as a rolled edge), which has a larger outer diameter than the associated neck portion 5 and is configured for connection to a closure member. As can be concluded from FIG. 1, the bottom edge of the rolled edge 6 can be slanted and may extend at an acute angle downward and toward the constricted neck portion 5. Alternatively, the bottom edge of the rolled edge 6 may also be flat and extend at a right angle relative to the constricted neck portion 5.

The neck portion 5 can be formed with smooth walls and without an external thread or may be provided with an external thread for screwing on a closure member. For example, a stopper (not shown) may be inserted in the inner bore of the neck portion 5 and the upper rim 6, whose upper end is connected with the upper rim 6 of the vial in a gas-tight manner and protected against the intrusion of contaminants into the vial, for example by crimping or beading a metal protective foil which is not shown. Such vials are radial symmetric and are made of a transparent or colored glass or of a suitable plastic material by blow molding or plastic injection molding techniques, and in general can be internally coated so that the material of the vial emits minimal impurities to the agent to be received.

A further example of containers in the sense of the present application are ampoules, carpoules, syringes or injection containers. Other examples of containers are also double-chamber cartridges and/or double-chamber syringes and/or cartridges or bottle carpules (vartridges).

In the sense of the present invention, such containers are used for the storage of substances or agents for cosmetic, medical or pharmaceutical applications, which are to be stored in one or several components in solid or liquid form in the container. Especially in the case of glass containers storage periods can amount many years, notably depending on the hydrolytic resistance of the glass type used. While, in the following, cylindrical containers are disclosed, it should be noted that the containers, in the sense of the present invention, may also have a different profile, for example a square, rectangular or polygonal profile.

Inevitably such containers have tolerances due to the production which can be of the order of one or several tenths of a millimeter in particular for glass containers. To compensate for such manufacturing tolerances, while ensuring that all bottoms 3 or bottom ends of the containers can be disposed in a plane, according to the present invention the containers are fixed on a supporting structure as outlined in the following. This supporting of the containers is implemented either in the transition region between the constricted neck portion 5 and the expanded upper rim 6 or in the region of the constricted neck 5. As described hereinafter, a supporting member is disposed in the region of the constricted neck portion 5, which engages with the constricted neck portion 5 in a positive-fit manner or preferably accommodates the latter with a certain radial play to compensate for tolerances and different outer diameters of different types of containers. This supporting member may be part of a supporting means or is formed by the latter that is clipped into a carrier in accordance with embodiments of the invention, as described below, to form a supporting structure for concurrently supporting a plurality of containers in apertures or receptacles.

FIG. 2*a* shows in a perspective plan view a strip-shaped supporting plate 10. A plurality of semi-circular recesses 11*a*, 11*b* are respectively formed at the left-hand and right-hand longitudinal side thereof at regular intervals from one another, which are each displaced relative to each other by about half the diameter of the recesses. At the ends of the supporting plates 10 holding clips 20 are formed. The supporting plates 10 are mirror-symmetric and can hence be inverted and clipped into a carrier in the same manner. Two such supporting plates 10, which contact each other along the line of contact 14, together form a supporting member, as shown in FIG. 2*b* in which a plurality of circular apertures 13 are formed for supporting the vials 2. The vials 2 are positively supported in the circular supporting recesses 13 in the region of their constricted neck portions below the expanded upper rims 6, however, they can in principle also be held by frictional and in particular be clamped. The upper rims 6 of the containers 2 can also rest loosely on the supporting plates. Although not shown in FIG. 2*b*, the two supporting plates 10 may be connected directly to one another, for example, they may be detachably locked to each other to form a subassembly in which the vials are securely held.

FIG. 2*c* shoes a supporting structure according to the present invention having two strip-shaped supporting plates 10 according to FIG. 2*a* which are clipped into a flat, rectangular-shaped carrier 30 in which apertures 31 are formed in a regular arrangement, the aperture widths of which being larger than the maximum outside dimensions of the vials 2. The supporting plates 10 are clipped to the upper side of the carrier 30 such that the recesses 11*a*, 11*b* are aligned with the apertures 31 in the carrier 30 and that the vials 2 extend through the apertures 31 in the carrier 30 downward so that the bottoms of the vials 2 are completely and freely accessible from the bottom side of the carrier 30.

Details of clip-coupling are show in the longitudinal sectional view of FIG. 2*d* and in the greatly enlarged partial sectional view of FIG. 2*c*. According to FIG. 2*e*, the clip 20 has a base 21 from which a latching hook or clamping hook 22 protrudes, which forms a receptacle 23 together with the base 21 in which the edge of the carrier 30 is clamped. In this case, the locking hook or clamping hook 22 embraces the edge of the carrier 30. The retaining clip 20, the carrier 30 and the supporting plates 10 are made of suitable plastics materials which have a sufficient resiliency to enable the clipping of the supporting plates into the carrier 30 and the releasing of the clip-coupling. As will be readily apparent to the person skilled in the art upon reading the foregoing description, the retaining clip can also be provided in a corresponding manner in the carrier 30 instead on the supporting plate 10. As retaining clips in the sense of the present application also correspondingly positive-fit elements of a different design can be used.

FIG. 2*f* shows a top view of the supporting structure (carrier) according to FIG. 2*c*.

FIG. 3*a* shows a supporting structure according to a further embodiment of the present invention in a perspective view. A regular array of apertures 31 is formed in the planar, rectangular carrier 30, the aperture widths of which are larger than a maximum outer dimensions of the vials 2, so that they can be inserted into the apertures 31 both from above the carrier 30 and from below the carrier 30. On the upper side of the carrier 30 a plurality of strip-shaped supporting plates 10 are disposed in parallel with each other. Here, respective pairs of adjacent supporting plates 10 support a row of vials 2 in the gap formed between these supporting plates 10. The width of this gap is preferably in each case slightly larger than the outer dimension of the vial 2 in the neck portion 5 (see FIG. 1) but smaller than the outer radius of the expanded upper rim 6 of the vials 2 (see FIG. 1). In this way, the vials 2 rest loosely with the bottoms of their expanded upper rims 6 on the upper sides of the strip-shaped supporting plates 10 and are supported on the carrier 30 secured axially in one direction without clamping the vials 2. According to further embodiments, the bottles 2 may also be supported on the carrier 30 by clamping, preferably in the region of the constricted neck portion 5 (see FIG. 1).

The strip-shaped supporting plates 10 can be clipped into the carrier 30 in the manner described above or otherwise secured to this to be removable again. In the embodiment of FIGS. 3*a* and 3*b*, the strip-shaped supporting plates 10 are, however, held clamped on the carrier 30. For this purpose, clamping webs 19 are provided along two opposite longitudinal sides of the carrier 30, which according to FIG. 3*a* respectively form a plurality of rectangular receptacles 19*c*, which can be seen better in the greatly enlarged sectional view of FIG. 3*c*. The clamping web 19 comprises a plurality of base portions 19*a* for connection with the carrier 30 and a plurality of pairs of side walls 19*b* vertically projecting from said base portions and forming the rectangular-shaped receptacles 19*c* (see FIG. 3*a*). Respective spacers 18 having a rectangular cross-section are arranged on the upper side of the carrier 30 in these rectangular receptacles 19*c*. These are preferably made of an elastic material, for example of an elastic plastic or rubber. According to FIG. 3*c*, the strip-shaped supporting plates 10 are inserted into the gap between the spacers 18 and the clamping web 19 and held clamped therein.

Alternatively, in a variant of the supporting structure according to FIGS. 3*a* to 3*c* the upper rims 6 of the vials 2 may also rest directly on the upper side of the carrier 30 if the outer diameters of the upper rims 6 are larger than the maximum outer dimensions of the vials 2 in the regions of the side walls 4 (see FIG. 1). In such a case, the strip-shaped supporting plates 10 rest on the upper rims 6 of the vials 2 for securing the vials 2 axially in two directions on the carrier 30. The heights of the spacers 18 correspond to at least the height of the expanded upper rim 6 of the vial 2 (see FIG. 1), but can also be larger. In this way, the axial play can be set with which the vials 2 are held in a positive-fit manner on the carrier 30.

FIGS. 4*a* and 4*b* show, in a schematic perspective view and in a sectional view, a supporting structure according to a further embodiment of the present invention in a state before the containers are held on the supporting structure. For the arrangement of the containers 2 on the supporting structure according to this embodiment, the containers 2 are inserted into the apertures 31 of the carrier 30. For this purpose, the containers can be temporarily supported on an external supporting surface 8, as schematically shown in FIG. 4*b*. Or the containers 2 can be held by a holding device (not shown), for example, by the holding device of a processing station, until the containers 2 are reliably held on the supporting structure. In the position according to FIG. 4*a* the upper rims 6 of the containers 2 sufficiently protrude out of the apertures 31, so that the undersides of the expanded upper rims 6 of the containers 2 are accessible to be supported by the supporting plates 10.

According to FIG. 4*a* the supporting plates 10 consist of two supporting wings 10*a*, 10*b* which together form a supporting plate 10 and are connected with each other via a film hinge or the like so that they can be moved toward each other and can be folded apart by pivoting about the common connection line. To this end the supporting plates are produced in particular by means of a 1K or 2K injection molding process from a plastic material, In the collapsed position of the supporting plates 10 of FIGS. 4*a* and 4*b*, in which the maximum width of the supporting plates 10 is smaller than the width of the interspaces 9 between the upper ends of adjacent containers 2, the supporting plates 10 can be introduced into the interspaces 9, as long as the upper ends of the supporting wings 10*a*, 10*b* are arranged below the undersides of the expanded upper rims 6 of the containers 2.

In this position, the supporting wings 10*a*, 10*b* may then be folded apart until the expanded upper rims 6 of the container 2 are supported on the upper ends of the supporting wings 10*a*, 10*b*. The undersides of the supporting plates 10 rest on the upper side of the carrier 30. In this position, an external supporting surface for the container 2, for example the external supporting surface 8 shown in FIG. 4*b*, is no longer needed, because the containers 2 hold the supporting wings 10*a*, 10*b* unfolded due to their weight and thus are directly supported on the upper ends of the supporting wings 10*a*, 10*b*. FIGS. 4*c* and 4*d* show the corresponding supporting structure in a schematic perspective view and in a sectional view in a state in which the containers 2 are supported on the supporting structure.

For re-folding the supporting wings 10*a*, 10*b*, it is advantageous when they are biased against each other elastically by a restoring force, which may be accomplished in a simple manner by the design and selection of the material of the supporting wings 10*a* and 10*b* and their connection region.

According to a first variant, the relaxed home position of the supporting wings 10*a*, 10*b* can be the collapsed position shown in FIGS. 4*a* and 4*b*, in which case the supporting wings 10*a*, 10*b* must be folded apart against an elastic restoring force. For such an unfolding of the supporting wings 10*a*, 10*b*, only the weight of the containers 2 may be sufficient. Or the containers 2 are actively pushed down relative to the supporting plates 10 until the undersides of the expanded upper rims 6 of the containers 2 get in contact with the upper ends of the supporting wings 10*a*, 10*b* to fold them further apart when the containers 2 are pushed-down further.

Or the supporting wings 10*a*, 10*b* are mechanically pressed apart in order to take the position shown in FIGS. 4*c* and 4*d*.

According to a second embodiment, the relaxed home position of the supporting wings 10*a*, 10*b* can be the unfolded position shown in FIGS. 4*c* and 4*d*, in which case the supporting wings 10*a*, 10*b* must be folded against an elastic restoring force to take the position shown in FIGS. 4*a* and 4*b*, but can be unfold automatically to take the position shown in FIGS. 4*c* and 4*d* after the insertion into the interspaces 9 between the containers 2. Of course, also here the folding and/or unfolding of the supporting wings 10*a*, 10*b* can be supported by mechanical intervention.

FIGS. 5*a* and 5*b* show a schematic sectional view of a supporting structure according to a further embodiment of the present invention in a state before the containers are supported on the supporting structure, and in a state in which the containers are supported on the supporting structure.

According to FIG. 5*a* resilient supporting arms 90 are pivotally mounted on the lower supporting plate 30*a* and extend through the apertures 31*b* in the upper supporting plate 30*b*. Alternatively, the resilient supporting arms 90 can extend through slots or apertures disposed at the sides of the apertures 31*b*. The containers 2 extend through the apertures 31*a*, 31*b* of the lower and upper supporting plate 30*a*, 30*b*, with the resilient supporting arms 90 extending into the interspaces 9 between the upper ends of the containers 2.

In the position shown in FIG. 5*a* the resilient supporting arms 90 are pivoted away from the containers 2, so that they can be inserted into the apertures or receptacles 9, which are formed by the front ends 94 of the supporting arms 90, in this position, the containers 2 are conveniently supported on an external supporting surface (not shown), similar to that shown in FIG. 4*b*.

For adjusting the supporting arms 90, according to FIG. 5*b* the distance between the supporting plates 30*a*, 30*b* is changed. Thereby the supporting arms 90 slide on the edges of the apertures 31 or of the slots or apertures 31*b* (not shown), and are thereby inwardly pivoted towards the containers 2 by an elastic force. In this position the expanded upper rims 6 of the containers 2 are secured in a positive-fit manner and in axial direction.

As shown in FIGS. 5*a* and 5*b*, on the upper ends of the supporting arms 90 wedge-shaped supporting projections 94 are provided, each having an upper slope 92 and a lower slope 93 to facilitate the insertion or removal of the container 2 out of this supporting structure.

According to FIG. 5*b* a gap 100 is provided between the front ends of the supporting projections 94 and the constricted neck portions 5 of the respectively held containers, so that the containers 2 are supported with a certain radial play on the supporting projections 94. Depending on the design of the supporting arms 90, the containers can be held clamped and elastically supported by the supporting projections 94; or square-shaped supporting receptacles may be formed in the supporting projections 94 which receive the expanded upper rims 6 of the containers 2 in a positive-fit manner, be it with a radial play and/or with an axial play or without such a play.

FIGS. 5*c* and 5*d* show a further variant of the embodiment of FIGS. 5*a* and 5*b*, in which the aforementioned adjustment of the resilient supporting arms 90 is additionally accomplished by a wedge-shape of the supporting arms 90 in cooperation with the apertures 31*b* or slots or apertures 31*c* in the upper supporting plate 30*b*. As can be concluded from FIGS. 5*c* and 5*d*, slopes 98 are formed on the inside of the resilient supporting arms 90, so that the supporting arms 90 starting from their lower end progressively widen towards the supporting projections 94. These slopes 98 act as control surfaces, in order to effect the adjustment of the supporting arms 90 in co-operation with the apertures 31*c* in the upper supporting plate 30*b*, which may also be identical to the apertures 31*b* of the upper supporting plate 30*b*.

With reference to FIGS. 6*a* to 6*k* a supporting structure according to a further embodiment of the present invention will be described in the following. The supporting structure comprises a lower supporting plate 30*a* having a plurality of apertures 31*a* and an upper supporting plate 30*b* having a plurality of apertures 31*b*, which are aligned with the apertures 31*a* of the lower supporting plate 30*a*. As can be seen in the sectional view of FIG. 6*c*, cylindrical side walls 85 are disposed on the upper side of the lower supporting plate 30*a* around the apertures 31*a* and resilient supporting arms 80 are respectively associated with the apertures 30*a*, which are arranged at equal angular distances from one another along the edge of the respective aperture 31*a*.

Figure 6A:
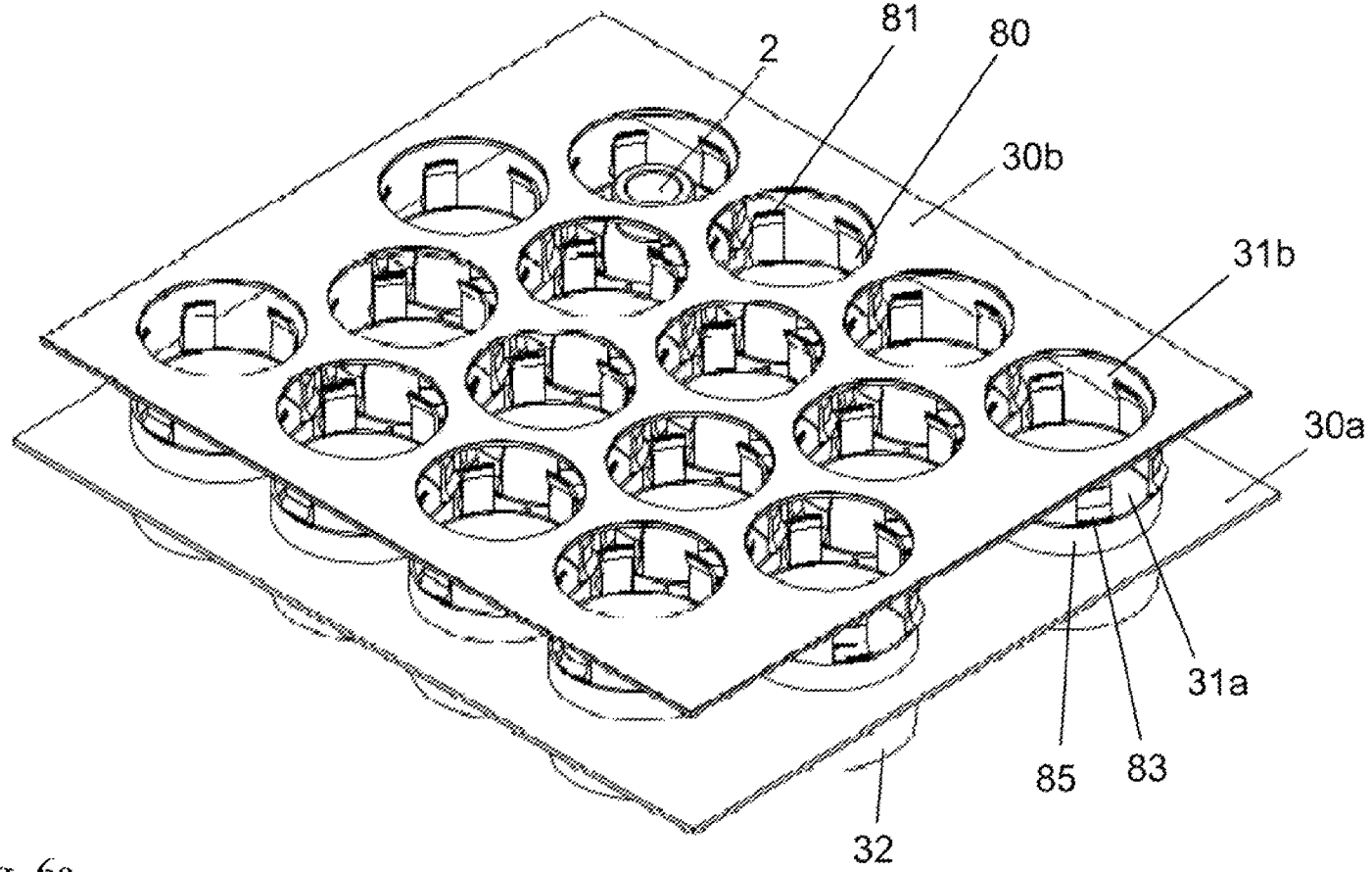
Figure 6B:
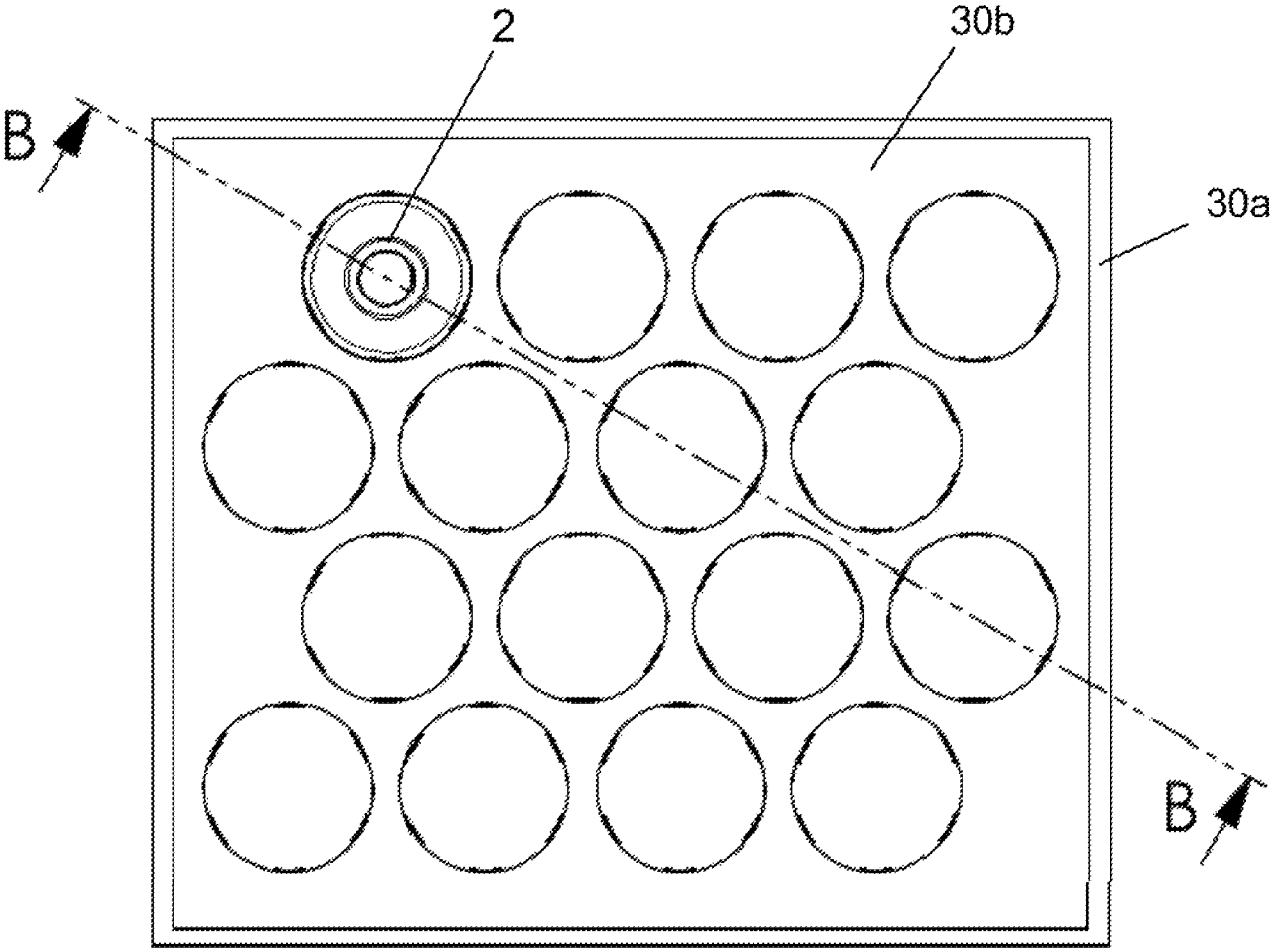
Figure 6C:
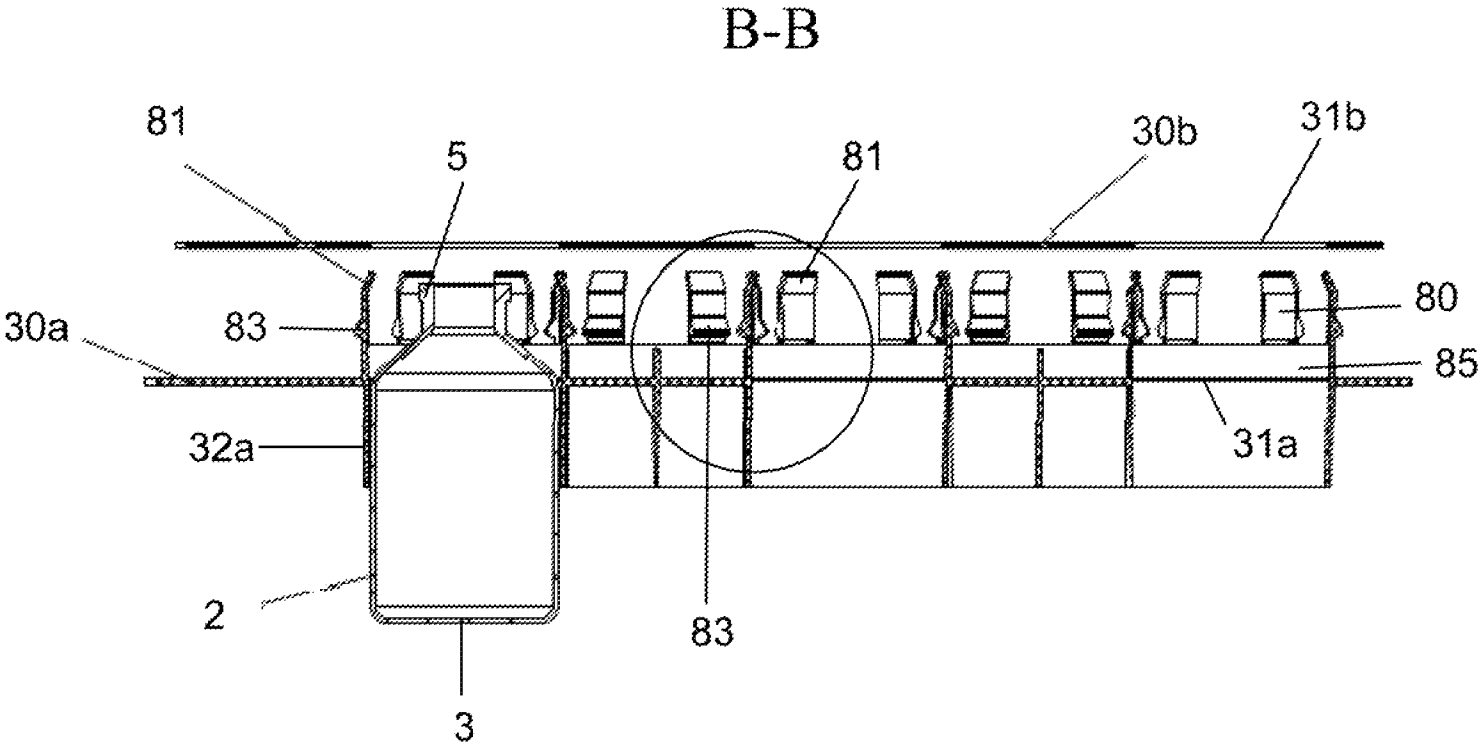
Figure 6D:
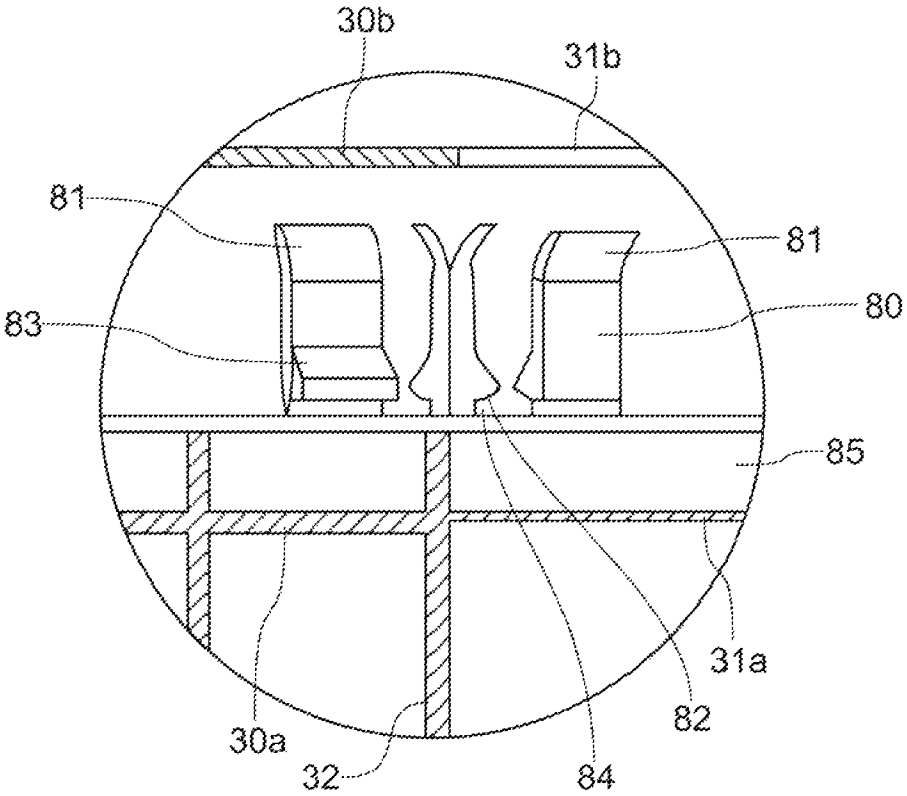

FIG. 6*d* shows a greatly enlarged partial sectional view of the portion encircled in FIG. 6*c*. As can be seen in the partial sectional view of FIG. 6*d*, the supporting arms 80 project essentially perpendicularly from the lower supporting plate 30*a*, wherein the front ends 81 of the supporting arms 80 extend in an arc shape into the respective aperture 31*a*. A locking nose or detent 83 projects from the outer side of each supporting arm 80, away from the respective aperture 31*a*. Between the underside of the locking nose 83 and the upper edge of the cylindrical side wall 85 a gap 84 is formed whose width corresponds to the thickness of the upper supporting plate 30*b*.

In the position shown in FIGS. 6*a* to 6*d*, the upper ends 81 of the supporting arms 80 do not touch the upper supporting plate 30*b*. Further, the supporting arms 80 are relaxed in this position. The aperture width of the receptacles formed by the supporting arms 80 in the relaxed state is larger than a maximum outer diameter of the containers 2 in the region of the upper rim 6, so that the containers 2 in any case can be inserted into these receptacles from below the lower supporting plate 30*a* or from above the lower supporting plate 30*a* while spreading of the supporting arms 80. Or the aperture width of the receptacles formed by the supporting arms 80 in the relaxed state is larger than a maximum outer diameter of the containers 2 in the regions of the cylindrical side walls 4, so that the container 2 can be inserted into these receptacles from above the lower supporting plate 30*a* also without spreading of the supporting arms 80. In the position shown in FIG. 6*c* the containers 2 in the receptacles can be supported temporarily on an external supporting surface (not shown), similar to that shown in FIG. 4*b*.

Figure 6E:
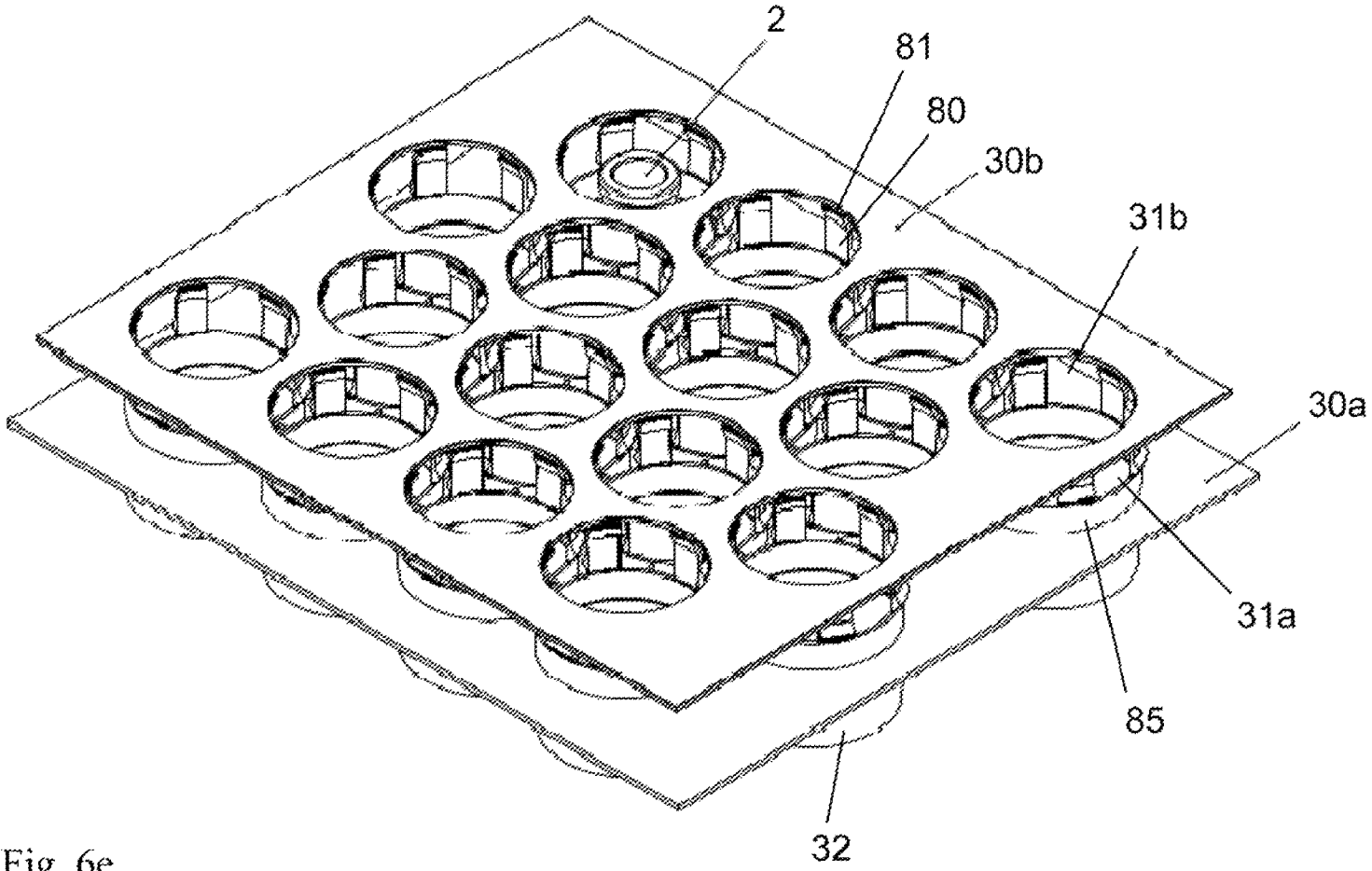
Figure 6F:
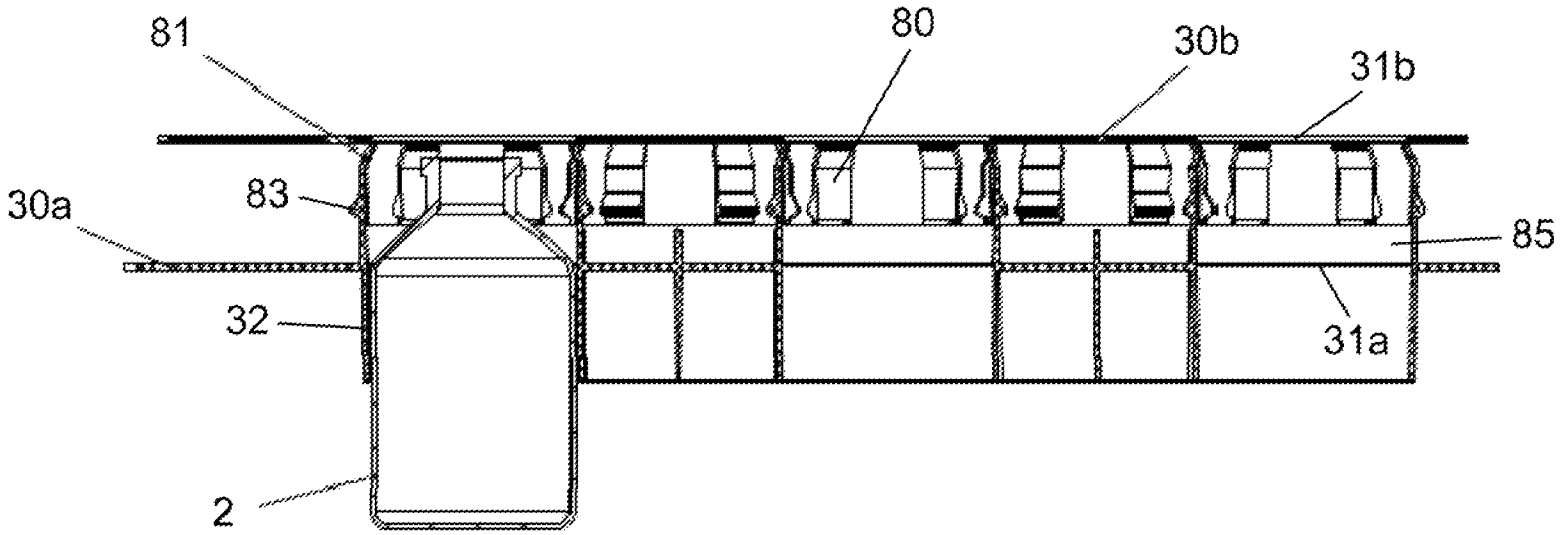

Upon further approach of the upper supporting plate 30*b* to the lower supporting plate 30*a*, the upper ends 81 of the supporting arms 80 enter the region of the apertures 31*b* of the upper supporting plate 30*b*, as shown in FIGS. 6*e* and 6*f*.

Figure 6G:
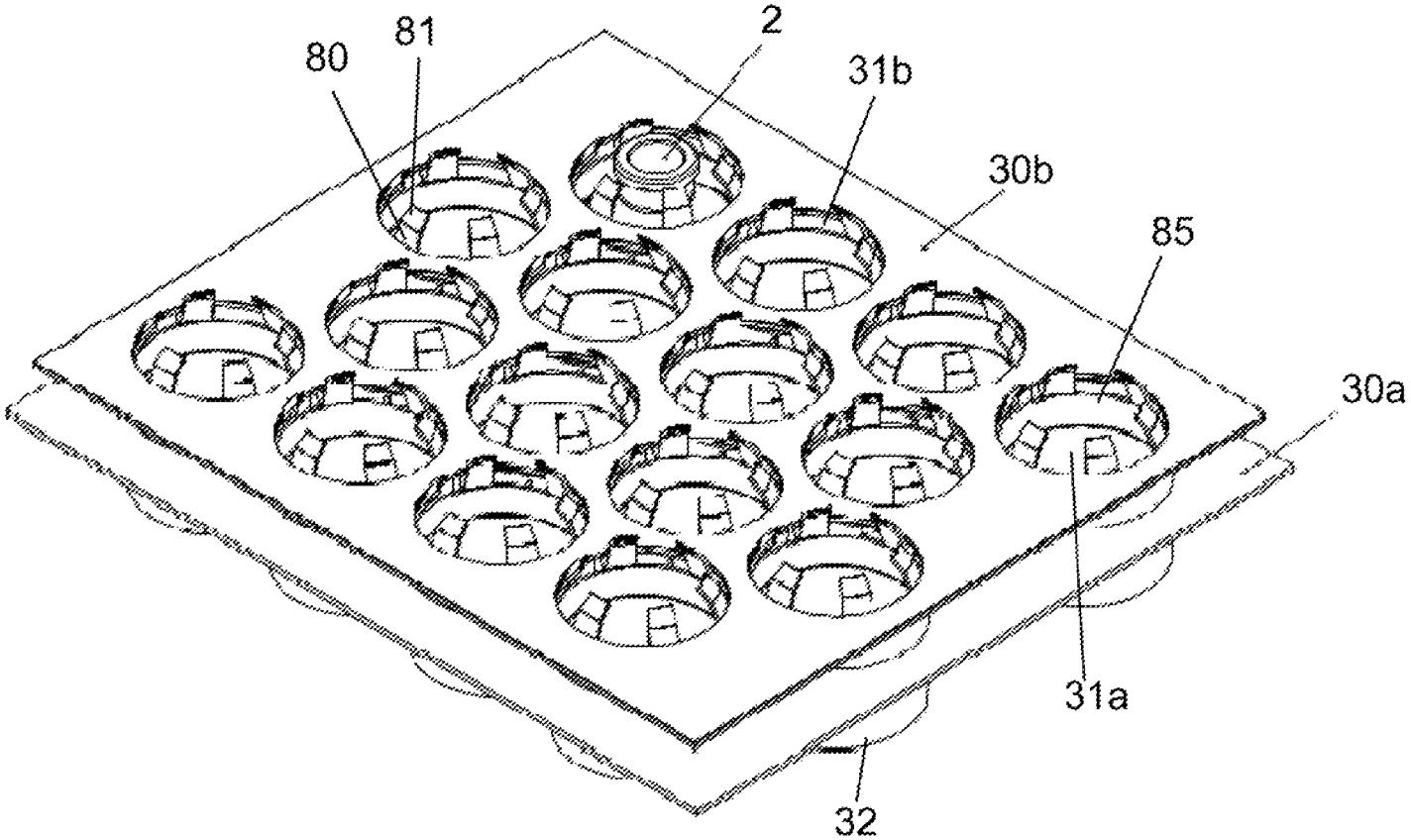
Figure 6H:
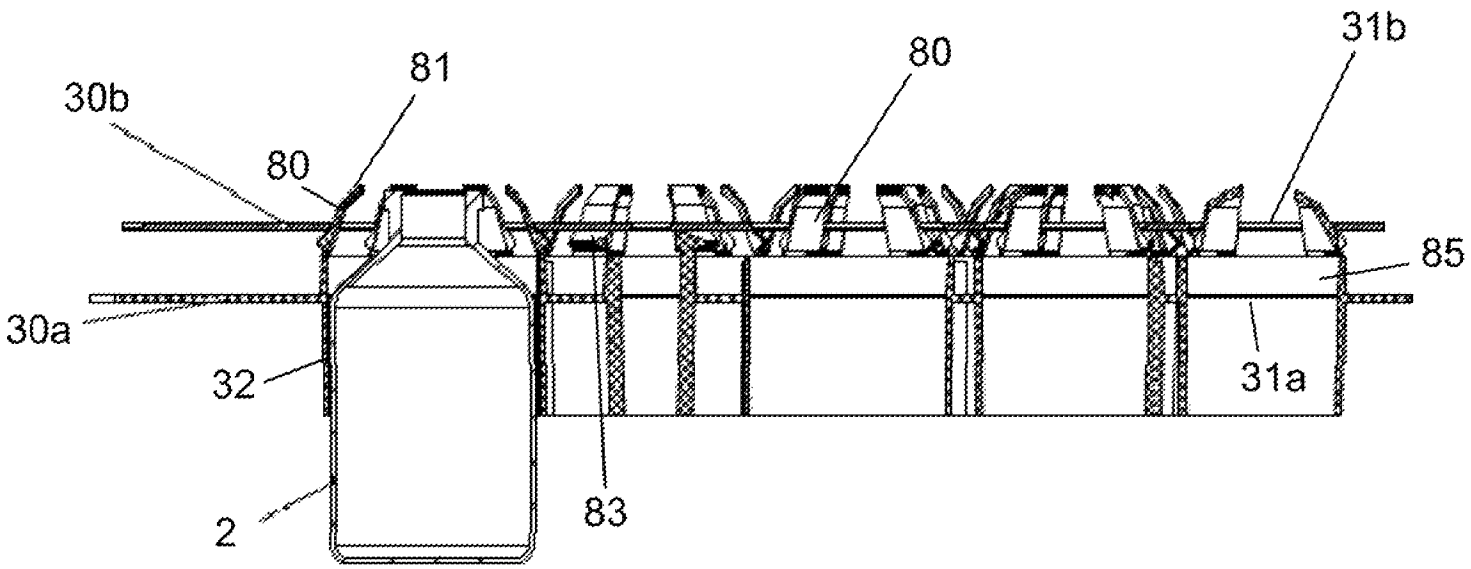
Figure 6I:
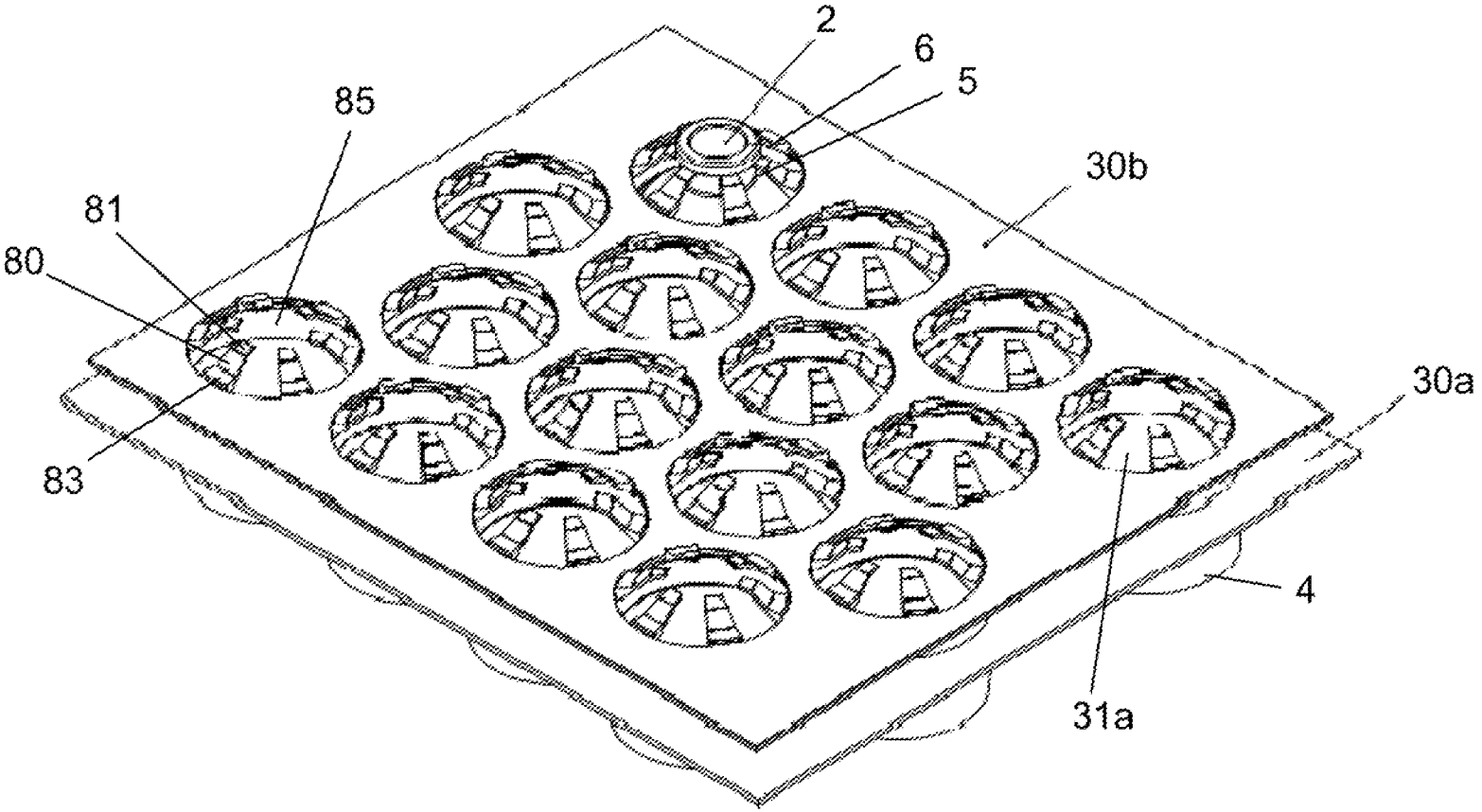

Upon further approach of the upper supporting plate 30*b* to the lower supporting plate 30*a* finally the front ends of the supporting arms 80 get in contact to the edges of the apertures 31*b* of the upper supporting plate 30*b*, so that e support arms 80 are gradually and resiliently bent inwardly as shown in FIGS. 6*g* and 6*h*.

Upon further approach of the upper supporting plate 30*b* to the lower supporting plate 30*a* finally the locking noses or detents 83 get in contact with the edges of the apertures 31*b* of the upper supporting plate 30*b*, as shown in FIGS. 6*g* and 6*h*.

Upon further approach of the upper supporting plate 30*b* to the lower supporting plate 30*a*, finally the locking noses 83 slide over the edges of the apertures 31*b* of the upper supporting plate 30*b*, which results in a further bending of the resilient supporting arms 80 radially inward.

Figure 6J:
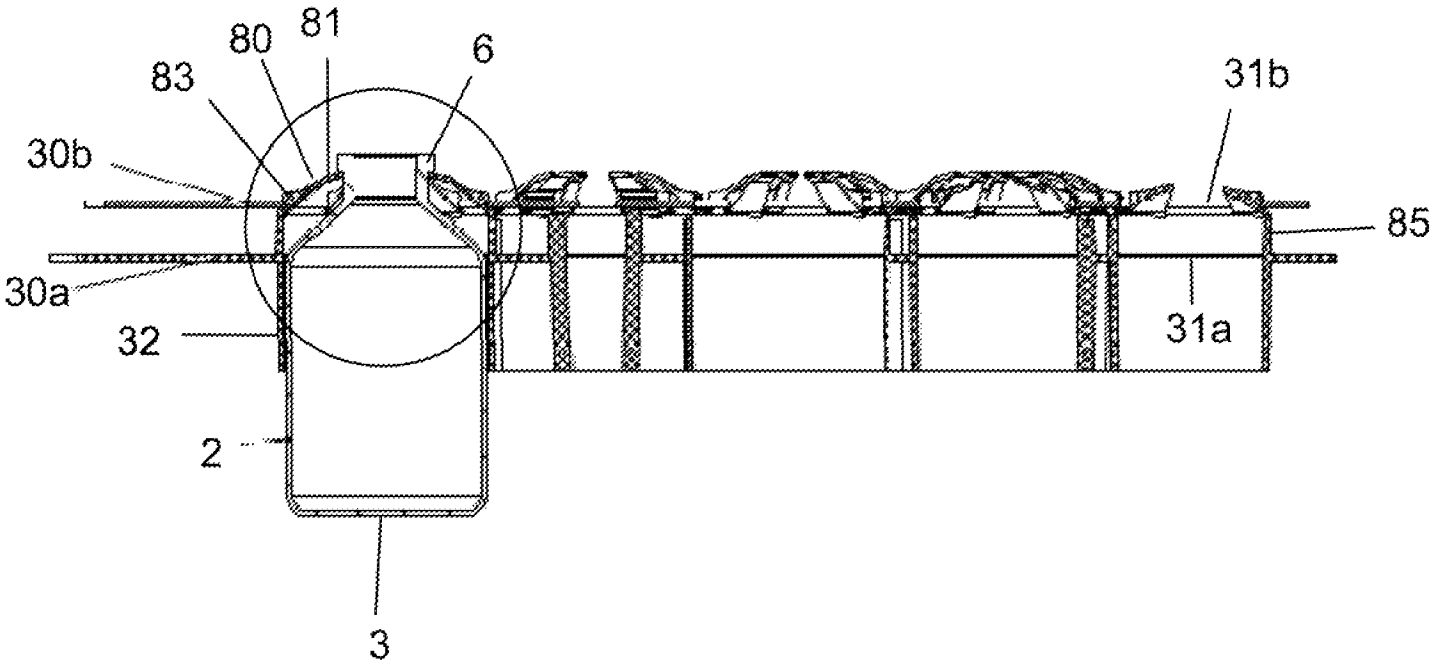
Figure 6K:
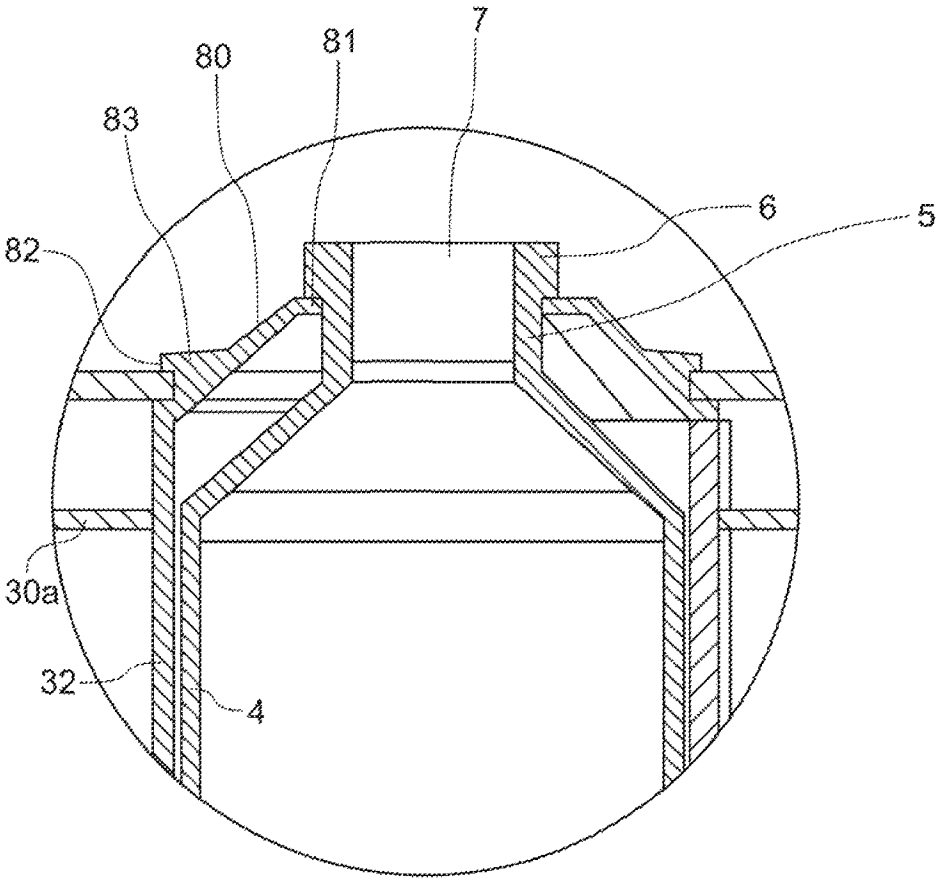

Upon further approach of the upper supporting plate 30*b* to the lower supporting plate 30*a*, the locking noses 83 finally slide completely across the edges of the apertures 31*b* of the upper supporting plate 30*b*, as shown in FIGS. 6*j* and 6*k*. Because the width of the gap 84 (see FIG. 6*d*) between the bottom of the locking nose or detent 83 and the upper edge of the cylindrical side wall 85 corresponds to or is larger than the thickness of the upper supporting plate 30*b*, the locking noses 83 can be clipped into the upper supporting plate 30*b*. This results in a maximum bending of the supporting arms 80 radially inward into the associated apertures 31*b* of the upper supporting plate. In this position, thus the lower supporting plate 30*a* is coupled to the upper supporting plate 30*b* by clipping of the locking noses or detents 83 into the apertures 31*b* of the upper supporting plate 30*b*.

As can be seen in the greatly enlarged partial sectional view of FIG. 6*k*, in this position the expanded upper rims 6 of the containers 2 are supported on the resilient supporting arms 80. Depending on the design of the supporting arms, the upper rims 6 of the containers 2 may rest loosely on the resilient supporting arms 80, with a certain radial play, as stated above, or, the front ends 81 of the resilient supporting arms 80 abut against the constricted neck portions 5 of the containers 2 or press against them to hold the containers 2 clamped. In this position, a support of the containers 2 on an external supporting surface, similar to that shown in FIG. 4*b*, is no longer necessary. Such a supporting structure can be inserted in a sterile transport and packaging container, as shown in an exemplary manner in FIG. 8*c*, and be stored sterile and transported therein.

For releasing the lower supporting plate 30*a* from the upper supporting plate 30*b* and releasing the containers 2, the procedure is performed in the reverse order. For this purpose, either the upper supporting plate 30*b* is moved away from the lower supporting plate 30*a* or a force acting on the resilient supporting arms 80 and/or the locking noses 83 ensures that the locking noses 83 again get out of engagement with the edges of the apertures 31*b* in the upper supporting plate 30*b*. The elastic characteristics of the supporting arms 80 critically contribute to this disengagement of the locking noses 83 at. By releasing the lower supporting plate 30*a* from the upper supporting plate 30*b* all containers 2 can be released concurrently.

Alternatively, the containers 2 can also be removed individually from the apertures 31*a*, 31*b* with a suitable design of the geometry and elastic characteristics of the resilient supporting arms 80.

With reference to FIGS. 7*a* to 7*f* a further embodiment of a supporting structure according to the present invention will be described in the following. The supporting structure consists of a lower supporting plate 30*a* having a plurality of apertures 31*a* and an upper supporting plate 30*b* having a plurality of apertures 31*b*, which are disposed in alignment with the apertures 31*a* of the lower supporting plate 30*a* in the position of the supporting plates 30*a*, 30*b* as shown in FIGS. 7*a*-7*c*.

Because the aperture widths of the apertures 31*a* and 31*b* are each larger than the maximum outer diameters of the upper rims 6 of the containers 2, the containers 2 can be inserted from below or above the lower supporting plate 30*a* into the apertures 31*a*, 31*b* and can be removed again from these apertures 31*a*, 31*b* upward or downward in this position of the supporting plates 30*a*, 30*b*.

The two supporting plates 30*a*, 30*b* can be displaced in parallel to each other in the direction of the longitudinal sides, which results in a reduction of the aperture width in the direction of adjustment of the apertures formed jointly by the apertures 31*a*, as can be concluded from the plan view of FIG. 7*d*. By displacement of the two supporting plates 30*a*, 30*b* relative to one another, the aperture widths of the apertures jointly formed by the apertures 31*a*, 31*b* can be set in an easy manner. E.g., the perpendicularly extending projections 30 on the underside of the lower supporting plate 30*a* and the edges of the apertures 31*b* in the upper supporting plate 30*b* can hold all the neck portions 5 of the container clamped, if the aperture width of the apertures formed jointly by the apertures 31*a*, 31*b* corresponds exactly to the outer diameter of the constricted neck portion 5. If the aperture width of the apertures formed jointly by the apertures 31*a*, 31*b* is slightly larger, the expanded upper rims 6 of the containers 2 can rest loosely on the edges of the apertures 31*b* in the upper supporting plate 30*b*, without holding the containers 2 clamped.

The position of the supporting plates 30*a*, 30*b* relative to each other can be secured by means of suitable connecting elements. In particular, the two supporting plate 30*a*, 30*b* can be locked with each other in the desired supporting position by means of locking elements.

FIG. 8*a* shows a schematic sectional view the supporting of a vial 2 in the supporting structure of FIG. 2*c*. In this case, the vial 2 is held positively in the region of the constricted neck portion 5. According to a preferred embodiment, the undersides of the rolled edges 6 of the vials rest loosely on upper sides of the supporting plates 10, preferably at the same time maintaining a certain radial play in the region of the constricted neck portions 5.

FIG. 8*b* shows in a schematic sectional view the supporting of a vial in a variant of the supporting structure of FIG. 2*c*, wherein side walls 32 project perpendicularly from the underside of the carrier 30, which surround the vials supported in the apertures of the carrier 30 at least partially in the circumferential direction, in order to prevent a collision of the directly adjacent containers.

A supporting structure as described above can be inserted into a trough-shaped transport and packaging container 60 and transported while being accommodated therein, as exemplified in FIG. 8*c*. According to FIG. 8*c* the transport and packaging container 60 is essentially box-shaped or trough-shaped and comprises a bottom 61, a circumferential side wall 62 protruding perpendicularly from this bottom 61, a step 63 substantially projecting perpendicularly from this and an upper rim 65, which is formed as a flange. Such a transport and packaging container 60 is preferably formed from a plastics material, particularly by plastic molding, and is preferably formed of a clear transparent plastic to enable an optical visual inspection of the supporting structure accommodated in the transport and packaging container 60 and of the containers 2 supported.

According to FIG. 8*c*, the step 63 of the transport container 60 is formed as a circumferential, planar support surface on which the supporting structure rests directly. In this way, the supporting structure can be positioned precisely in the transport container 60 and the plurality of containers 2 can be placed in this way in a regular array and at precisely defined positions in a transport container 10 having standard dimensions. In particular it can be ensured in this way that all the bottoms of the containers are arranged in a common plane and in parallel w the bottom 61 or the upper rim 65 of the transport container 10.

Although the bottom 11 of the transport container 10 is shown in FIG. 8*c* to be closed and formed integrally with the side wall 62, the lower end of the transport container 60 may also be formed open in the manner of the upper end, in particular with a flange-like bottom rim in the manner of the upper rim 65 so that the bottoms of the containers are freely accessible from the underside of the transport container 60, e.g. for processing steps in a sterile tunnel or in a freeze-dryer, as explained in detail below.

The transport container 1 comprises measures for identifying and/or tracking as follows: as shown in the enlarged insert of FIG. 8*c*, an electronic wirelessly readable RFID chip or RuBee chip 52 (a RuBee chip transmits at frequencies that can penetrate metal and water) is disposed in the region of the access aperture 63 between the supporting plate 30 and the side wall 62 and/or the step 63 of the container, which can be read out in a contact-less manner through the side walls of the packaging unit I and outputs information with regard to identity, important product characteristics (manufacturer, content, production date, expiry date, . . . ) if queried. The chip 52 may be glued into the packaging unit 1 at a suitable position, also at a different position than shown in the figure. The chip 52 may be arranged such that in the case that the packaging unit 1 is opened or that the supporting plate 30 is taken out of the packaging unit 1, the chip 52 is destroyed, for example is broken or getting inoperative. Due to lack of response from the chip 52 to a radio query an information is therefore available, which indicates that the packaging unit must have been manipulated in some way since the previous packaging process. Because the chip 52 does not respond to the radio query. This can for example be used to prove the authenticity and integrity of the packaging unit and the containers accommodated therein.

FIGS. 9*a* to 9*c* show plan views of supporting means according to further embodiments of the present invention. According to FIG. 9*a* a plurality of annular receptacles 43 are distributed along the rectangular support web 40 spaced apart from each other at regular intervals. The receptacles 43 are formed by two semi-circular ring segments 41, between which an insertion opening 42 is formed through which the containers can be inserted radially and inwardly. Between these supporting elements interspaces 44 are formed, so that the supporting elements can also be formed from relatively narrow plastic webs, which are flexible and elastically bendable. The supporting web 40 (not shown) is clipped in a carrier in the manner described above.

In the variant according to FIG. 9*b* the circular receptacles 43 are formed only along one longitudinal side of the supporting web 40. In this embodiment, lines of weakness or weakened areas 45 are formed in the supporting web 40 at regular intervals, where it can be broken apart into smaller sub-units.

In the variant according to FIG. 9*c* these lines of weakness or weakened areas 45 are provided between all the circular receptacles 43.

FIGS. 9*d*-9*f* exemplify various basic forms of retaining receptacles 43. According to the FIG. 9*e* the semi-circular webs 41 are formed relatively strong and therefore have a relatively small resiliency. According to FIG. 9*f*, the support receptacle has a square-shaped cross-section, wherein the aperture width of the receptacle 43 formed by the inner edges 47 is larger than the clear width between the edges 46 of the insertion aperture 42.

According to the present invention, a plurality of containers can be held together on a carrier and, while they are held at the carrier or are at least guided by the carrier, they can be treated or further processed. As will become apparent to the person skilled in the art upon reading the foregoing description, this approach is generally suitable for any processing steps for the treatment or processing of containers for the storage of substances for cosmetic, medical or pharmaceutical applications.

The holding force respectively exerted by the supporting member on the container is sufficient to reliably support the containers on the supporting structure. In particular, the holding force exerted is greater than the weight of the container, if necessary together with the content and the sealing plug. According to further embodiments, the holding force can also be set by suitable design of the supporting means so that it is greater than a force usually prevailing during handling, processing or treatment of the containers in a processing apparatus. This measure always ensures a reliable supporting of the containers. Nevertheless, the containers can be displaced, in particular can be pushed axially forward or rotated, in the apertures or receptacles by simply gripping and adjustment of the supporting members with the containers respectively supported without any major resistance.

For inserting, removing or displacing the containers in a carrier the containers simply need to be inserted into the receptacles of the supporting members and these need to be clipped into the supporting structure such that the containers are inserted into the apertures or receptacles of the carrier. The supporting of the containers that can be attained in this manner is sufficiently stable so that continue to reliably supported on the carrier upon application of a small force, such as caused by shocks of the processing apparatus or of conveying means, and that they do not fall over accidentally. This considerably reduces the risk of unintentional impurities in processing plants.

A further considerable advantage of the present invention is that the containers can be inserted in axial direction from above into the apertures or receptacles of the carrier and can also be removed or displaced upwardly. The risk of accidental intrusion of particles into the internal volume of the containers can be minimized in this manner.

Other advantages are as follows:

- A freeze-drying of substances stored in the containers is possible, while the containers are supported on the supporting structure (so-called nest), because the bottoms of the containers are accessible from the underside of the supporting structure and thus can rest directly on a cooling surface of a freeze-dryer.
- Weighing of the containers and sealing the containers with plastic caps and crimping the containers is possible, while the containers are supported on the supporting structure, because the containers can be displaced in axial direction on the supporting structure and can be particularly lifted.
- The containers can be easily inserted from above back into the apertures or receptacles of the supporting structure. Therefore, the containers never need be removed from the supporting structure for pharmaceutical processes. This does not require handling tools, enables a high packing density of the containers, especially during freeze-drying, prevents a glass-to-glass contact in the process and allows for a safe transport of the containers, because relative movements of the containers relative to the supporting structure are limited. Overall, a favorable, stable and high-quality filling process is made possible.

A direct contact of the bottoms of all containers, which are held by the supporting structure, is even possible if the supporting structure is warped and for different lengths of the containers.

The supporting structure and the supporting means can be produced using simple molding tools that are in particular free from undercuts.

Of course, the supporting structure (nest) and/or the transport and packaging container (tub) in the sense of the present invention can be formed of a thermoplastic, thermosetting or elastomeric plastic, and/or can be provided at least with portions of the supporting structure or of the carrier having a coating reducing friction to facilitate the insertion and removal of the containers. Also so-called cycloolefin copolymers (COC) or cyclo-olefin polymers (COP) can be used. These offer the advantage of high transparency and offer mechanical properties similar to commercially available plastic containers As will become apparent to the skilled person in the art upon reading the foregoing description, the various aspects and features of the embodiments described above may be combined and claimed in any suitable manner, resulting in numerous further embodiments and modifications. As will become apparent to the skilled person in the art upon studying the foregoing description and drawings all such other embodiments and modifications shall be covered by the present invention as long as they do not depart from the general approach and the scope of the present invention, as defined in the appended claims.

LIST OF REFERENCE NUMERALS

2 vial
3 bottom of vial
4 side wall
5 neck
6 upper rim/rolled edge
7 aperture for filling
8 external supporting surface
9 interspace
10 strip-shaped supporting plate
10*a* left wing of the supporting plate 10
10*b* right wing of the supporting plate 10
11*a* left recess
11*b* right recess
12*a* left longitudinal edge
12*b* right longitudinal edge
13 holding aperture
14 line of contact
17 gap
18 spacer
19 clamping web
19*a* base of clamping web 19
19*b* vertical side wall of clamping web 19
19*c* receiving aperture of clamping web 19
20 supporting clips
21 basis
22 locking hook
23 receptacle
30 carrier
30*a* lower carrier
30*b* upper carrier
31 aperture
31*a* aperture in the lower carrier 30*a*
31*b* aperture in the upper carrier 30*b*
31*c* aperture or slot in the upper carrier 30*b*
31 aperture
32 partition wall
35 holding clip
36 connecting web
37*a* base
37*b* upper insertion slope
37*c* lower insertion slope
37*d* locking recess
37*e* supporting surface
39 extension on the lower carrier 30*a*
40 supporting web
41 supporting member
42 insertion aperture
43 receptacle
44 interspace
45 predetermined breaking line/weakening region
46 inner edge of the insertion aperture 42
47 inner edge of receptacle 43
50 sensor
51 RuBee-chip
52 RFID-chip
60 transport and packaging container
61 bottom
62 sidewall
63 supporting surface
64 sidewall
65 upper edge
66 aperture for access
80 resilient supporting arm
81 front end of supporting arm 80
82 locking nose
83 slope on locking nose 82
84 gap
85 cylindrical sidewall
90 resilient supporting arm
91 supporting projection
92 upper slope of supporting projection 91
93 lower slope of supporting projection 91
94 front end of supporting projection 91
100 gap

What is claimed is:

1. A supporting structure for supporting a plurality of containers for substances for medical, pharmaceutical or cosmetic applications, each container having a constricted neck portion near an open end thereof, the supporting structure comprising:

a flat, rectangular-shaped carrier having a plurality of apertures or receptacles and a plurality of supporting members releasably coupled to the flat, rectangular-shaped carrier, wherein each supporting member is formed as a strip and extends in the direction of a longitudinal side of the flat, rectangular-shaped carrier, wherein the supporting members support the containers, when the containers are positioned in the supporting structure, to said flat, rectangular-shaped carrier by a positive-fit that is formed by coupling the respective supporting member with the flat, rectangular-shaped carrier so that the containers are supported on the flat, rectangular-shaped carrier and extend into the apertures or receptacles of the flat, rectangular-shaped carrier, and wherein the containers are retained at the supporting members in axial direction by a positive-fit engagement of the supporting members in the region of the constricted neck portion and below an expanded upper rim following the constricted neck portion.

2. The supporting structure of claim 1, wherein the positive-fit is formed such that the containers respectively rest loosely with the underside of the expanded upper rim.

3. The supporting structure of claim 1, wherein each supporting member has an annular supporting piece for embracing the outer periphery of the containers in a positive-fit manner, wherein said annular supporting pieces are arranged at uniform distances from one another and along the respective supporting member, and wherein each annular receptacles has an aperture width that is larger than the outer diameter of the constricted neck portion of the container but smaller than the outer diameter of an upper rim of the container, which follows the constricted neck portion.

4. The supporting structure of claim 1, wherein respective pairs of adjacent supporting members support the plurality of containers on the carrier in rows and columns, and further comprise a plurality of semi-circular recesses that are formed along at least one longitudinal side of the supporting members, which form a plurality of annular receptacles in cooperation with the semi-circular recesses of a directly adjacent strip-shaped supporting member.

5. The supporting structure of claim 4, wherein the semi-circular recesses are offset relative to each other along opposite longitudinal sides of the supporting members.

6. The supporting structure of claim 1, wherein the supporting members are configured so that bottoms of the containers supported at the supporting structure are freely accessible from an underside of the supporting structure for a treatment or processing of the containers, while they are supported on the supporting members.

7. The supporting structure of claim 1, wherein the supporting members are respectively held on the flat, rectangular-shaped carrier by clamping.

8. The supporting structure of claim 1, wherein the supporting members are respectively coupled with the flat, rectangular-shaped carrier with a clip-coupling, wherein at least one first latching element is disposed on the flat, rectangular-shaped carrier or on the respective supporting member, wherein at least one second latching element is disposed on the respective supporting member or on the flat, rectangular-shaped carrier, and wherein the first and the second latching element can be latched for coupling the flat, rectangular-shaped carrier with the respective supporting member.

9. The supporting structure of claim 8, wherein the supporting members have a plurality of apertures formed therein and the supporting members are supported on the flat, rectangular-shaped carrier so that they can be moved in parallel relative to the flat, rectangular-shaped carrier, wherein, in a first position of the supporting member relative to the flat, rectangular-shaped carrier, the apertures of the supporting members are aligned with the apertures or receptacles of the flat, rectangular-shaped carrier so that the upper ends of the containers can be inserted into the apertures of the supporting member, and said supporting members can be displaced by parallel displacement relative to the flat, rectangular-shaped carrier to a second position, in which the positive-fit is accomplished by the cooperation of the apertures in the supporting member with the apertures or receptacles in the flat, rectangular-shaped carrier for supporting the containers on the flat, rectangular-shaped carrier.

10. A transport or packaging container for a plurality of containers for substances for medical, pharmaceutical or cosmetic applications, comprising a box-shaped container; and at least one supporting structure for supporting a plurality of containers for substances for medical, pharmaceutical or cosmetic applications, the plurality of containers having a constricted neck portion near an open end thereof, wherein said supporting structure is in the box-shaped container;

said supporting structure comprising a flat, rectangular-shaped carrier having a plurality of apertures or receptacles, and a plurality of supporting members, which are releasably coupled to the flat, rectangular-shaped carrier, which are each formed as a strip and which extend in the direction of a longitudinal side of the flat, rectangular-shaped carrier, wherein the supporting members support the plurality of containers to said flat, rectangular-shaped carrier by a positive-fit, which is formed by coupling the respective supporting member with the flat, rectangular-shaped carrier in so a manner that the containers supported on the flat, rectangular-shaped carrier extend into the apertures or receptacles of the flat, rectangular-shaped carrier and that the containers are retained at the supporting members in axial direction by a positive-fit engagement of the supporting members in the region of the constricted neck portion and below an expanded upper rim following the constricted neck portion.

11. The supporting structure of claim 1, wherein the supporting members are each formed as a flat, planar strip coupled with the flat, rectangular-shaped carrier to extend in parallel with and directly adjacent to the flat, rectangular-shaped carrier.

12. A combination of a supporting structure and a plurality of containers for substances for medical, pharmaceutical or cosmetic applications, wherein the containers are supported by the supporting structure, wherein each of the plurality of container has a constricted neck portion near an open end thereof, the supporting structure comprising:

a flat, rectangular-shaped carrier having a plurality of apertures or receptacles; and a plurality of supporting members releasably coupled to the flat, rectangular-shaped carrier, wherein each of the plurality of supporting members is formed as a strip and extends in the direction of a longitudinal side of the flat, rectangular-shaped carrier, wherein the supporting members support the plurality of containers to the flat, rectangular-shaped carrier by a positive-fit that is formed by coupling the respective supporting member with the flat, rectangular-shaped carrier so that the containers are supported on the flat, rectangular-shaped carrier and extend into the apertures or receptacles of the flat, rectangular-shaped carrier, and wherein the containers are retained at the supporting members in axial direction by a positive-fit engagement of the supporting members in the region of the constricted neck portion and below an expanded upper rim following the constricted neck portion.

* * * * *